US005447820A

United States Patent [19]

Hayakawa et al.

[11] Patent Number: 5,447,820

[45] Date of Patent: Sep. 5, 1995

[54] SILVER HALIDE PHOTOGRAPHIC LIGHT-SENSITIVE MATERIAL

[75] Inventors: Hiroshi Hayakawa; Toshihide Ezoe; Toshiaki Kubo, all of Kanagawa, Japan

[73] Assignee: Fuji Photo Film Co., Ltd., Kanagawa, Japan

[21] Appl. No.: 262,322

[22] Filed: Jun. 17, 1994

[30] Foreign Application Priority Data

Jun. 18, 1993 [JP] Japan ..... 5-147596

[51] Int. Cl.[6] ..... G03C 1/06

[52] U.S. Cl. ..... 430/264; 430/298

[58] Field of Search ..... 430/264, 598

[56] References Cited

U.S. PATENT DOCUMENTS 4,912,016 3/1990 Machonkin et al. ..... 430/264
4,968,592 11/1990 Deguchi et al. ..... 430/378
4,988,604 1/1991 Machonkin et al. ..... 430/264
5,221,593 6/1993 Onadera et al. ..... 430/264
5,279,919 1/1994 Okamura et al. ..... 430/264
5,316,889 5/1994 Sakai ..... 430/264

FOREIGN PATENT DOCUMENTS 0446078 9/1991 European Pat. Off. .

*Primary Examiner*—Thomas R. Neville
*Attorney, Agent, or Firm*—Sughrue, Mion, Zinn, Macpeak & Seas

[57] ABSTRACT

Disclosed is a silver halide photographic light-sensitive material for plate making which has an excellent rapid processing performance and a high processing stability. The silver halide photographic light-sensitive material comprises a support having provided thereon at least one silver halide light-sensitive emulsion layer, wherein at least one of (i) the at least one emulsion layer and (ii) another hydrophilic colloid layers(s) contains a compound represented by Formula (I).

13 Claims, No Drawings

SILVER HALIDE PHOTOGRAPHIC LIGHT-SENSITIVE MATERIAL

FIELD OF THE INVENTION

The present invention relates to a silver halide photographic light-sensitive material and a super high contrast negative image-forming process using the material, specifically to a silver halide photographic light-sensitive material used for a photomechanical process.

BACKGROUND OF THE INVENTION

In a field of a graphic art, a forming system for an image having a super high contrast photographic characteristic (particularly, gamma is 10 or more) is needed in order to improve reproducibility of an image with a continuous gradation by a halftone dot image and reproducibility of a line image.

There is known as a method in which a stable developing solution is used to obtain a high contrast photographic characteristic, the methods using hydrazine derivatives described in U.S. Pat. Nos. 4,224,401, 4,168,977, 4,166,742, 4,311,781, 4,272,606, 4,211,857, 4,912,016, and 4,998,604, and JP-A-3-259240 (corresponding to U.S. Pat. No. 5,221,593) (the term "JP-A" as used herein means an unexamined Japanese patent application) and JP-A-5-45761 (corresponding to U.S. Pat. No. 5,279,919). A super high contrast and high sensitive photographic characteristic can be obtained according to these methods, and furthermore, since it is allowed to add sulfite in a high concentration to a developing solution, stability of the developing solution to air oxidation is remarkably improved as compared with that of a lithographic developing solution.

However, it has found that conventional hydrazine compounds have several defects. That is, it was tried to provide the structures of the conventional hydrazine compounds with an anti-diffusible property for the purpose of decreasing an adverse influence to the other photographic materials by flowing into a development processing solution. Since these anti-diffusible hydrazine compounds are necessary to be used in a large amount for a sensitization and to increase contrast, a physical strength of a light-sensitive layer obtained is deteriorated and the hydrazine compounds are deposited in a coating solution of the light-sensitive layer. Furthermore, there has been found a problem that processing in a fatigued developing solution in which a lot of the light-sensitive materials are processed can not provide a sufficiently high contrast.

In general, a contact work light-sensitive material handled in a daylight occupies a large area as one of the light-sensitive materials for a photomechanical processing, and in this field, a high superimposed letter image quality by which even a fine Ming letter is reproduced. That has required a development of a nucleus-forming agent having a higher activity. Particularly in a daylight light-sensitive material which has such a low sensitivity as can be handled even in a daylight, since it is difficult to obtain a high contrast by the nucleus-forming agent, the nucleus-forming agent having further high activity is desired.

A silver halide photographic light-sensitive material using a hydrazine compound of the following formula is described in JP-A-3-259240:

$$R^1—S—L—C(O)—N(R^2)—J—X—NHNH—C(O)—R^3$$

wherein $R^1$ is an alkyl group, an alkenyl group, an alkynyl group, an aryl group, or a heterocyclic group, and L is an alkylene group or an alkenylene group.

A silver halide photographic light-sensitive material using a hydrazine compound of the following formula is described in JP-A-2-25843 (corresponding to U.S. Pat. No. 4,912,016):

$$R—S—CH_2—CONH\text{-phenylene-}NHNH—CHO$$

wherein R is an alkyl group having a carbon number of 1 to 8 or a cycloalkyl group having 4 to 8 carbon atoms in a ring.

Further, a silver halide photographic light-sensitive material using a hydrazine compound of the following formula is described in JP-A-5-45761:

$$R^1—L^1—R^2—L^2—R^3—NHNH—G^1—R^4$$

It is described in this patent that a case in which $R^1$ is an ethylene oxide group, a pyridinium group or an alkylthio group substituted with a quaternary ammonium group is preferred. $L^1$ represents $—SO_2NR^5—$, $—NR^5SO_2NR^5—$, $—NR^5CONR^5—$, or $—G^2P(O)(G^2R^5)—NR^5—$.

However, it has been found that the defects described above can not sufficiently be improved with the hydrazine compounds concretely described in these patents.

SUMMARY OF THE INVENTION

The object of the present invention is to provide a silver halide photographic light-sensitive material for a photomechanical processing, which excels in a rapid processing aptitude and has a high processing stability.

The subject of the present invention has been solved by a silver halide photographic light-sensitive material comprising a support and provided thereon at least one silver halide light-sensitive emulsion layer, wherein at least one of the at least one emulsion layer and the other hydrophilic colloid layer(s) contains a compound represented by the following Formula (I):

$$R^1—S—R^2—G^3—N(R^{11})—C(=X)—N(R^{12})—(R^3—L^2)_m—R^4—NHNH—G^1—R^5 \quad (I)$$

wherein $R^1$ represents an aliphatic group, an alicyclic group, or an aromatic group;

$R^2$ represents a $—R^{21}CO—$ group, a $—R^{21}SO_2—$ group, a $—R^{21}SO—$ group, a $—R^{21}COCO—$ group, a thiocarbonyl group, an iminomethylene group, a $—R^{21}P(O)(G^2R^6)—$ group, a divalent aliphatic group, a divalent alicyclic group, or a divalent aromatic group;

$G^3$ represents a single bond, a —O— group, a $—N(R^6)—$ group, a divalent aliphatic group, a divalent alicyclic group, or a divalent aromatic group;

$R^{11}$ and $R^{12}$ each represents a hydrogen atom, an aliphatic group, an alicyclic group, or an aromatic group;

X represents an oxygen atom, a sulfur atom or a $=NR^6$ group;

$R^3$ and $R^4$ each represents a divalent aliphatic group, a divalent alicyclic group, or a divalent aromatic group;

$L^2$ represents a $—SO_2N(R^6)—$ group, a $—N(R^6)SO_2N(R^6)—$ group, a $—CON(R^6)—$ group, a $—N(R^6)CON(R^6)—$ group, or a $—G^2—P(O)(G^2R^6)N(R^6)—$ group;

$G^1$ represents a —CO— group, a $—SO_2—$ group, a —SO— group, a —COCO— group, a thiocarbonyl group, an iminomethylene group, or a —P(O)($G^2R^6$)— group;

$R^5$ represents a hydrogen atom, an aliphatic group, an alicyclic group, an aromatic group, an alkoxy group, an aryloxy group, or an amino group;

m represents 0 or 1;

$R^1$ and $R^{11}$, $R^1$ and $R^{12}$, $R^{11}$ and $R^{12}$, and $R^1$, $R^{11}$ and $R^{12}$ may be combined with each other to form a ring;

$G^2$ represents a single bond, a —O— group or a N($R^6$)— group;

$R^6$ represents a hydrogen atom, an aliphatic group, an alicyclic group, or an aromatic group; and $R^{21}$ represents a single bond, a divalent aliphatic group, a divalent alicyclic group, or a divalent aromatic group.

DETAILED DESCRIPTION OF THE INVENTION

The compound represented by Formula (I) will be explained in further details.

In Formula (I), the aliphatic group or the alicyclic group represented by $R^1$ contains preferably 1 to 30 carbon atoms and is particularly preferably a linear, branched or cyclic alkyl group containng 1 to 20 carbon atoms. (In the present invention the carbon number disclosed in definitions for a group does not include the carbon number for substituents substituted to the group.)

Preferred examples of each group in Formula (I), are described below in detail.

In Formula (I), the aromatic group represented by $R^1$ is a monocyclic or dicyclic aryl group or an unsaturated heterocyclic group (preferably a 5- to 7- membered heterocyclic toups containing at least one of N, O, and S atoms), wherein the unsaturated heterocyclic group may be condensed with an aryl group. The aromatic group preferably has 6 to 30 carbon atoms.

The aliphatic group, alicyclic group, or aromatic group represented by $R^1$ may be substituted. Examples of the representative substituents include an alkyl group, an aralkyl group, an alkenyl group, an alkynyl group, an aryl group, an amino group, a ureido group, a urethane group (e.g., an alkoxycarbonylamino group and an aryloxycarbonylamino group), an aryloxy group, a sulfamoyl group, a carbamoyl group (an aminocarbonyl group), an alkyl- or arylthio group, an alkyl- or arylsulfonyl group, an alkyl- or arylsulfinyl group, a hydroxy group, a halogen atom (e.g., CA, F, Br and I), a cyano group, a sulfo group, an aryloxycarbonyl group, an acyl group, an alkoxycarbonyl group, an acyloxy group, an aliphatic- or aromatic- carbonamido group (an acylamino group), an aliphatic- or aromatic- sulfonamido group, a carboxyl group, a phosphoric amido group, a diacylamino group, and an imido group. (In the present invention an aryl group or moiety represents, for example, a phenyl group, a naphthyl group or moieties thereof, and an acyl group or moiety represents, for example, an aliphatic acyl group and an aromatic acyl group, or moieties thereof.)

Examples of the particularly preferred substituents include an aryl group in the case where $R^1$ is an alkyl group, an alkyl group and an aralkyl group in the case where $R^1$ is an aryl group, and an alkylthio group (that containing 1 to 20 carbon atoms is preferred), an arylthio group (that containing 6 to 20 carbon atoms is preferred), an amino group (a mono- or dialkyl-substituted amino group is included and up to 20 carbon (in total) atoms are preferred), a carbamoyl group (that containing up to 30 carbon atoms is preferred), an alkoxycarbonyl group (that containing 2 to 20 carbon atoms is preferred), an acylamino group (that containing 2 to 30 carbon atoms is preferred), a sulfonamido group (that containing 1 to 30 carbon atoms is preferred), a ureido group (that containing 1 to 30 carbon atoms is preferred), and a phosphoric amido group (that containing 1 to 30 carbon atoms is preferred) in the case where $R^1$ is an alkyl group or an aryl group. These groups may further be substituted with at least one substituent, for example, those as disclosed above as the examples of substituent for $R^1$.

In Formula (I), the aliphatic group or the alicyclic group represented by $R^{11}$ or $R^{12}$ is a linear, branched or cyclic alkyl group preferably containing 1 to 30 carbon atoms.

In Formula (I), the aromatic group represented by $R^{11}$ or $R^{12}$ is a monocyclic or dicyclic aryl group or an unsaturated heterocyclic group (preferably 5- to 7-membered heterocyclic groups containing at least one of N, O, and S atoms), wherein the unsaturated heterocyclic group may be condensed with an aryl group.

The aliphatic group, alicyclic group, or aromatic group represented by $R^{11}$ or $R^{12}$ may be substituted, and the representative substituent therefor includes an alkoxy group in addition to those enumerated as the substituents for $R^1$. The preferred substituent includes an alkyl group (preferably containing 1 to 20 carbon atoms), an aralkyl group (preferably containing 7 to 30 carbon atoms), an alkoxy group (preferably containing 1 to 20 carbon atoms), a mono- or di- substituted amino group (preferably substituted with an alkyl group containing 1 to 20 carbon atoms (in total)), an acylamino group (preferably containing 2 to 30 carbon atoms), an aliphatic- or aromatic- sulfonamido group (preferably containing 1 to 30 carbon atoms), a ureido group (preferably containing 1 to 30 carbon atoms), and a phosphoric amido group (preferably containing 1 to 30 carbon atoms). These groups may further be substituted with at least one substituent, for example, those as disclosed as the examples of substituent for $R^1$.

Preferred as $R^{11}$ and $R^{12}$ are a hydrogen atom, an alkyl group (containing 2 to 20 carbon atoms) substituted with an alkylthio group or an arylthio group, an alkyl group containing 1 to 20 carbon atoms, and an aryl group.

In Formula (I), $R^1$ and $R^{11}$, $R^1$ and $R^{12}$, $R^{11}$ and $R^{12}$, and $R^1$, $R^{11}$ and $R^{12}$ may be combined with each other to form a ring, preferably a 4- to 10- membered rings.

In Formula (I), $R^2$ represents a —$R^{21}$CO— group, a —$R^{21}SO_2$— group, a —$R^{21}$SO— group, a —$R^{21}$COCO— group, a thiocarbonyl group, an iminomethylene group, a —$R^{21}$P(O)($G^2R^6$)— group, a divalent aliphatic group, a divalent alicyclic group, a divalent aromatic group, preferably a —$R^{21}$CO— group, a —$R^{21}$ $SO_2$— group, a —$R^{21}$COCO— group, a —$R^{21}$P(O)($G^2R^6$)— group, a divalent aliphatic group, a divalent alicyclic group, or a divalent aromatic group, and particularly preferably a —$R^{21}$CO— group, a divalent aliphatic group, a divalent alicyclic group, or a divalent aromatic group.

The divalent aliphatic group and the divalent alicyclic group represented by $R^2$ contains preferably 1 to 30 carbon atoms and is particularly preferably a linear, branched or cyclic alkylene group containing 1 to 20 carbon atoms.

In Formula (I), the aromatic group represented by $R^2$ is a monocyclic or dicyclic arylene group or a divalent unsaturated heterocyclic group such as 5- to 7-membered heterocyclic groups (for example, a divalent pyridine ring group), wherein the unsaturated heterocyclic group may be condensed with an aryl group.

Particularly preferred as $R^2$ are an alkylene group containing 1 to 20 carbon atoms and an arylene group.

Groups represented by $R^2$ may further be substituted. Those enumerated as the substituents for $R^{11}$ and $R^{12}$ can be applied as the representative substituent therefor.

In Formula (I), the divalent aliphatic or alicyclic group represented by $R^{21}$, $R^3$ or $R^4$ contains preferably 1 to 30 carbon atoms and is particularly preferably a linear, branched or cyclic alkylene group conatining 1 to 20 carbon atoms.

In Formula (I), the aromatic group represented by $R^{21}$, $R^3$ or $R^4$ is a monocyclic or dicyclic arylene group or a divalent unsaturated heterocyclic group (preferably 5- to 7- membered heterocyclic groups containing at least one of N, O and S atoms), wherein the unsaturated heterocyclic group may be condensed with an aryl group.

Preferred as $R^{21}$ are an alkylene group conatining 1 to 10 carbon atoms and a phenylene group. Preferred as $R^3$ and $R^4$ is an arylene group and particularly preferred is that containing a benzene ring (i.e., substituted or unsubstituted benzene ring).

The aliphatic groups, alicyclic groups or aromatic groups represented by $R^{21}$, $R^3$ and $R^4$ may be substituted, and those cited as the substituents for $R^{11}$ and $R^{12}$ can be applied as the representative substituents therefor.

Of the groups represented by $L^2$ in Formula (I), particularly preferred is a $—SO_2N(R^6)—$ group.

Of the groups represented by $G^3$ in Formula (I), particularly preferred is a single bond, a —O— group, or a $—N(R^6)—$ group. Of the groups represented by X in Formula (I), preferred is an oxygen atom or a sulfur group, and the oxygen atom is particularly preferred.

In Formula (I), m is preferably 1 but may be 0.

The alkyl group represented by $R^5$ in Formula (I) is preferably an alkyl group conatining 1 to 4 carbon atoms and the aryl group is preferably a monocyclic or dicyclic aryl group or an unsaturated heterocyclic group (such as 5- to 7-membered heterocyclic groups containing at least one of N, O and S atoms).

In the case where $G^1$ is a —C(O)— group, the preferred one of the groups represented by $R^5$ is a hydrogen atom, an alkyl group (for example, methyl, trifluoromethyl, methoxymethyl, phenoxymethyl, 3-hydroxypropyl, 3-methanesulfonamidopropyl, and phenylsulfonylmethyl), an aralkyl group (for example, o-hydroxybenzyl), and an aryl group (for example, phenyl, 3,5-dichlorophenyl, o-methanesulfonamidophenyl, 4-methanesulfonylphenyl, 2-hydoxymethylphenyl, and pyridinium). The hydrogen atom is particularly preferred.

$R^5$ may be substituted and the substituents cited for $R^1$, $R^{11}$ and $R^{12}$ can be applied.

A —CO— group is most preferred as $G^1$ in Formula (I).

Also, $R^5$ may permit the moiety of $G^1—R^5$ to split off from the residue of a molecule and may cause a cyclization reaction to form a cyclic structure containing the atoms in the moiety of $—G^1—R^5$ (for example, a phenyl group having —CO— as $G^1$ and a hydroxymethyl group at the o- position of the phenyl group), and the compounds described in, for example, JP-A-63-29751 can be enumerated as the example thereof.

A hydrogen atom or an alkyl group conatining 1 to 6 carbon atoms is preferred as $R^6$ and the hydrogen atom is particularly preferred. In the case where the compound represented by Formula (I) contains two or more $R^6$ and $G^2$, they may be the same or different and $R^6$ may be substituted. Those cited as the substituents for $R^{11}$ and $R^{12}$ can be applied as the representative substituents therefor.

$R^1$, $R^{11}$, $R^{12}$, $R^2$, $R^3$, $R^4$, or $R^5$ in Formula (I) may have a ballast group or a polymer incorporated thereinto, which is conventionally used for an immobile photographic additive such as a coupler. The ballast group contains 8 or more carbon atoms and the group is comparatively inactive to the photographic characteristics and can be selected from, for example, an alkyl group, an alkoxy group, a phenyl group, an alkylphenyl group, a phenoxy group, and an alkylphenoxy group. Also, the compounds described in JP-A-1-100530 can be cited as the polymer.

$R^1$, $R^{11}$, $R^{12}$, $R^2$, $R^3$, $R^4$, or $R^5$ in Formula (I) may be that into which the group strengthening adsorption to a surface of a silver halide grain is incorporated. Examples of such a adsorbing group include the groups described in U.S. Pat. Nos. 4,385,108 and 4,459,347, JP-A-59-195,233, JP-A-59-200,231, JP-A-59-201,045, JP-A-59-201,046, JP-A-59-201,047, JP-A-59-201,048, JP-A-59-201,049, JP-A-61-170,733, JP-A-61-270,744, JP-A-62-948, JP-A-63-234,244, JP-A-63-234,245, and JP-A-63-234,246, such as a thiourea group, a heterocyclic thioamido group, a mercapto heterocyclic group, and a triazole group.

The specific examples of the compounds represented by Formula (I) are listed below but the present invention will not be limited thereto.

I-1

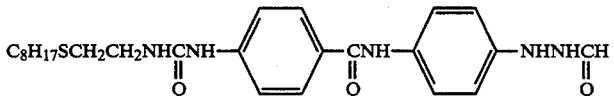

I-2

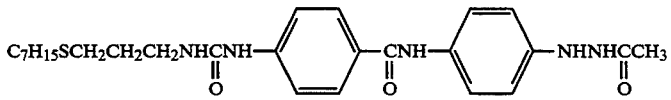

I-3

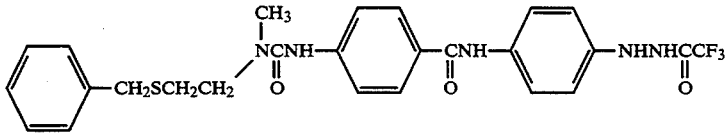

-continued
I-4
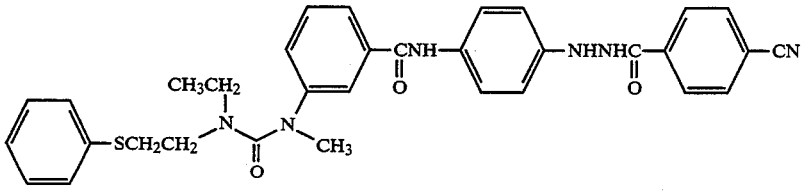
I-5
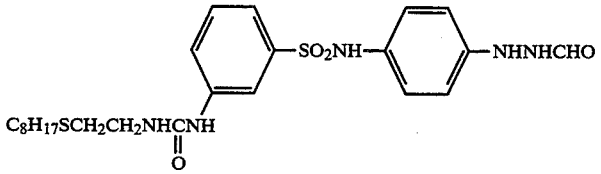
I-6
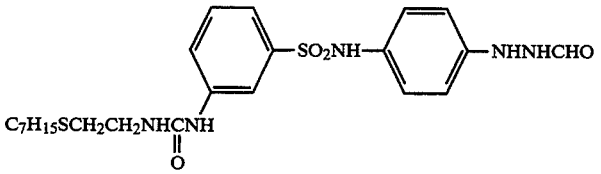
I-7
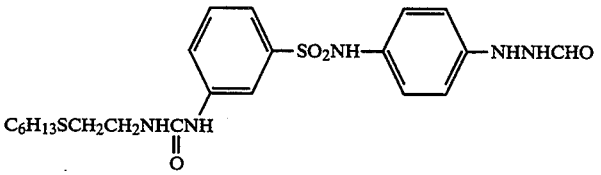
I-8
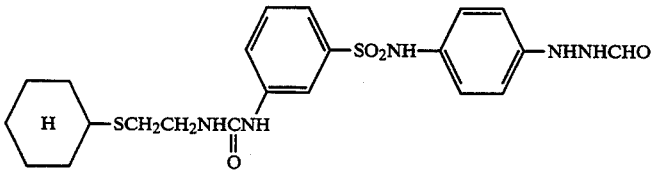
I-9
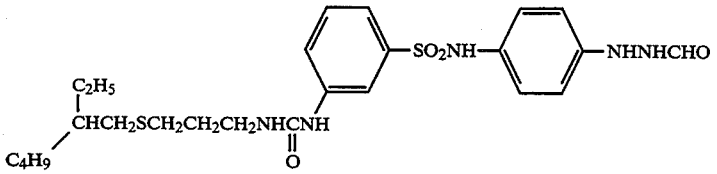
I-10
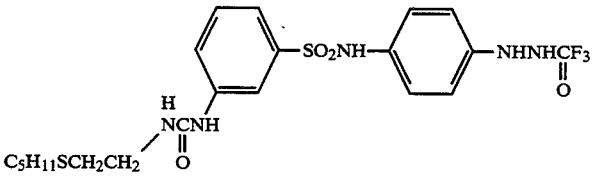
I-11
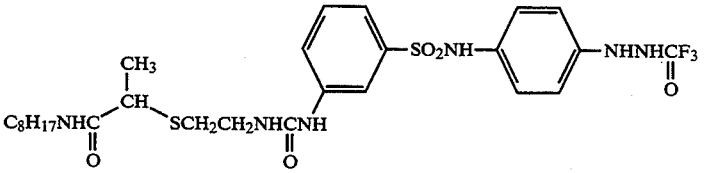

-continued
I-12
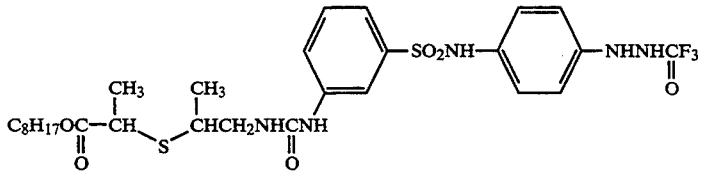
I-13
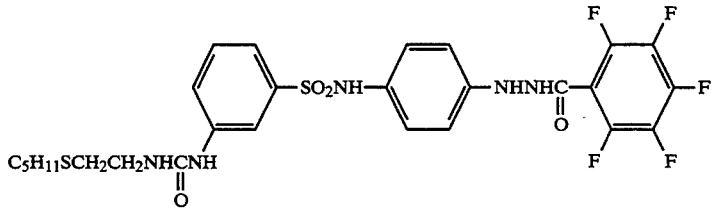
I-14
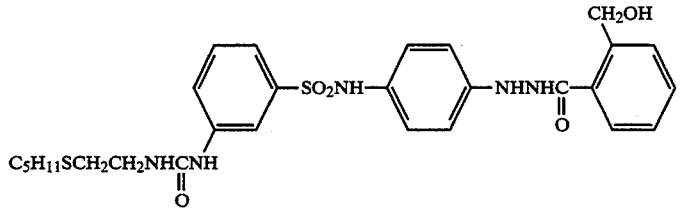
I-15
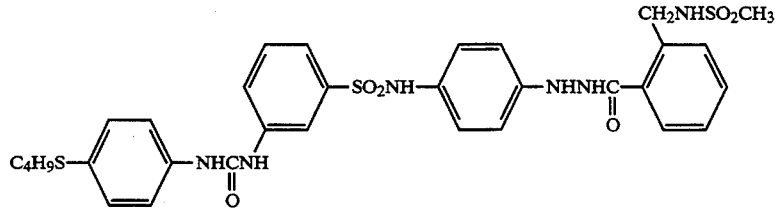
I-16
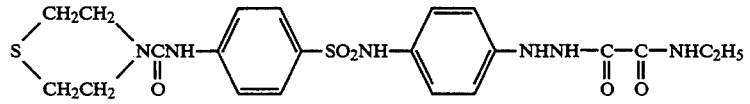
I-17
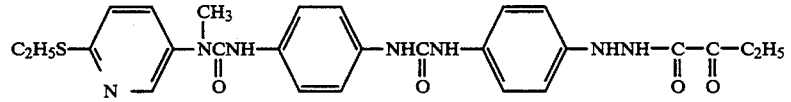
I-18
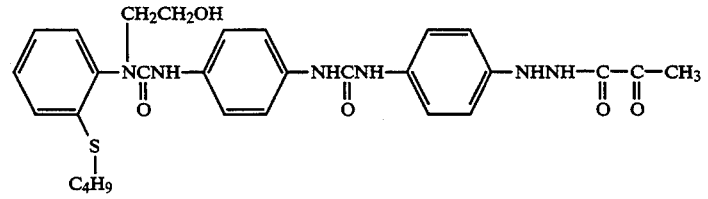
I-19
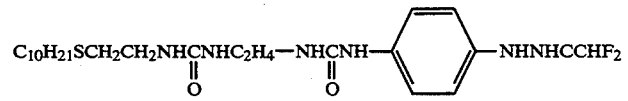
I-20
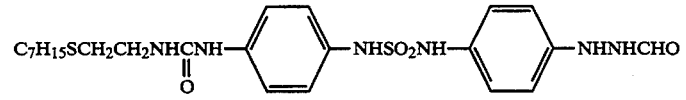

-continued
I-21
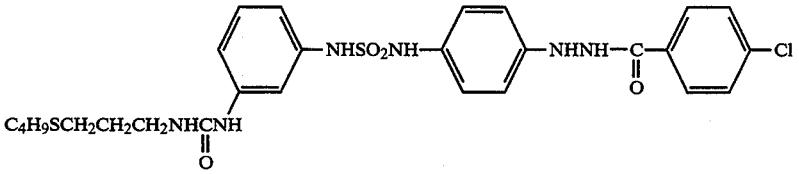
I-22
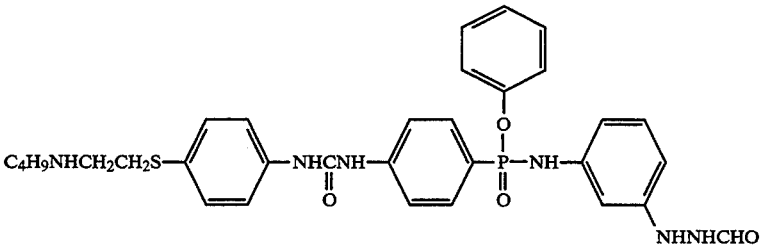
I-23
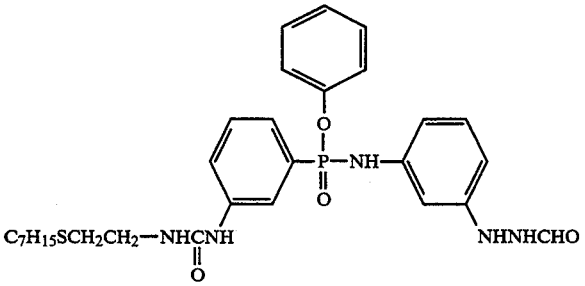
I-24
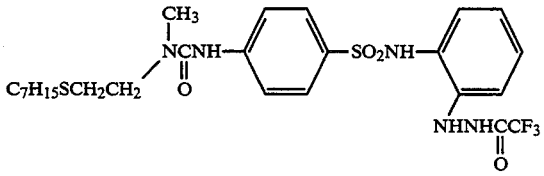
I-25
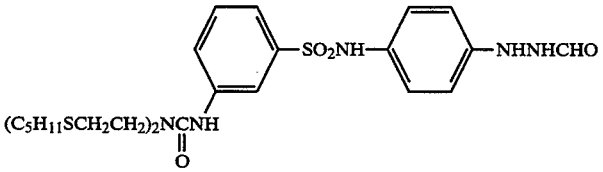
I-26
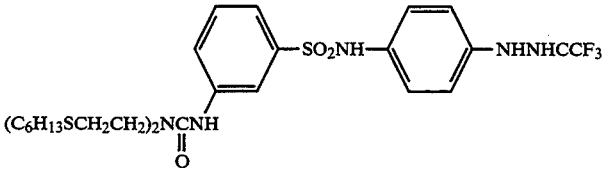
I-27
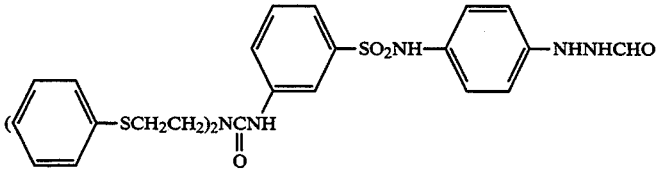

-continued
I-28
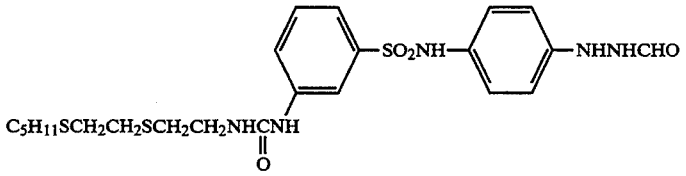
I-29
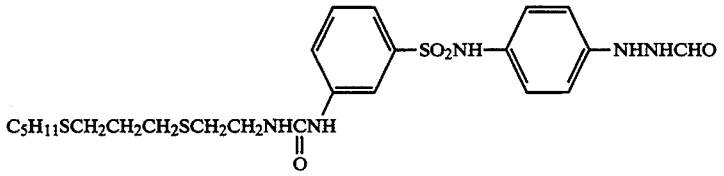
I-30
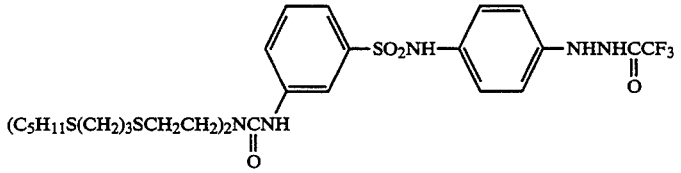
I-31
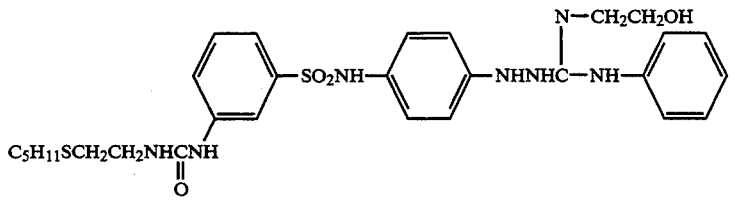
I-32
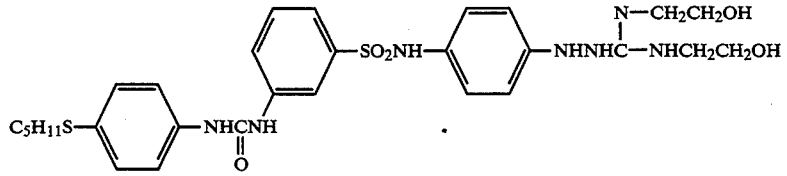
I-33
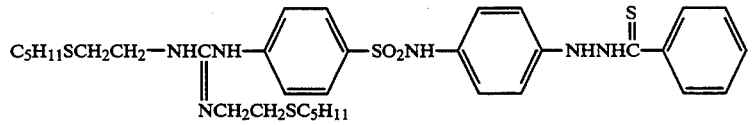
I-34
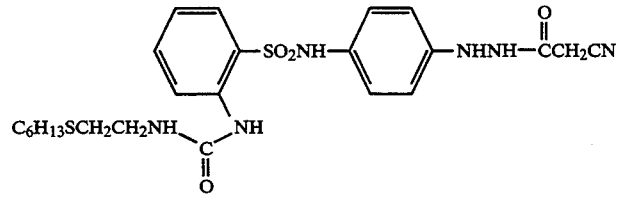
I-35
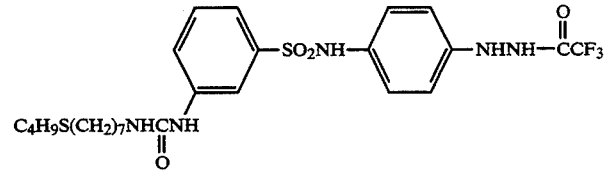

-continued

I-36

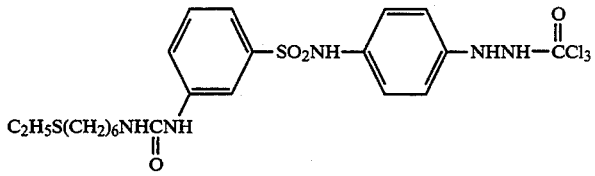

I-37

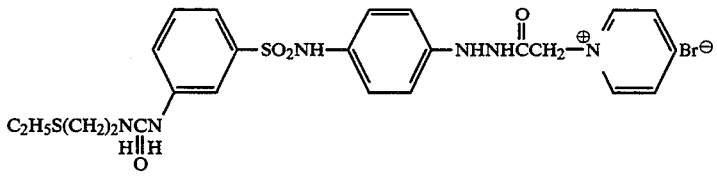

I-38

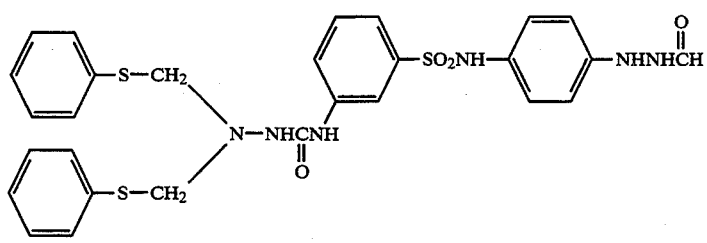

The hydrazine compounds of the present invention were synthesized by applying the processes described in, for example, JP-A-61-213,847 and JP-A-62-260,153, U.S. Pat. Nos. 4,648,604, 3,379,529, 3,620,746, and 4,377,634, 4,332,878, JP-A-49-129,536, JP-A-56-153,336, JP-A-56-153,342, and JP-A-1-269936, and U.S. Pat. Nos. 4,988,604 and 4,944,365.

SYNTHETIC EXAMPLE

Synthesis of the Exemplified Compound I-6

The compound B (16.7 g) was added to a mixed solution of the following raw material compound A (11.5 g) and dimethylacetoamide (30 ml) and stirred under a nitrogen atmosphere at a room temperature for 6 hours. After finishing a reaction, a reaction solution was poured into a mixed solution of ethyl acetate (1 liter) and water (1 liter) and a deposited white solid matter was filtered off. The solid matter thus obtained was recrystallized with acetonitrile to thereby obtain the aimed substance (12.0 g). The structure of the compound was confirmed with an NMR spectrum and an IR spectrum. Melting point: 152° to 153° C.

Compound A

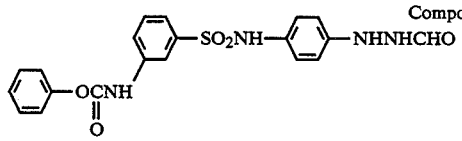

Compound B $C_7H_{15}SCH_2CH_2NH_2$

The other compounds were synthesized as well in the similar manners.

The hydrazine derivatives of the present invention can be dissolved in a suitable solvent compatible with water, for example, alcohols (methanol, ethanol, propanol, and fluorinated alcohol), ketones (acetone and methyl ethyl ketones), dimethylformamide, dimethylsulfoxide, and methyl cellosolve to use them.

Further, the hydrazine derivatives can be dissolved with an aid of an oil such as dibutyl phthalate, tricresyl phosphate, glyceryl triacetate, and diethyl phthalate, and an auxiliary solvent such as ethyl acetate and cyclohexanone to mechanically prepare the emulsified dispersions thereof by the well known dispersing methods to use them as well. Alternatively, a powder of a redox compound can be dispersed in water by a method known as a solid matter dispersing method with a ball mill, a colloid mill or a supersonic wave to use it as well.

An addition amount of the hydrazine compound in the present invention is preferably from $1\times10^{-6}$ mole to $5\times10^{-2}$ mole per mole of silver halide, and particularly preferably is from $1\times10^{-2}$ mole to $2\times10^{-2}$ mole per mole of silver halide.

In the present invention, the compound represented by Formula (I) is incorporated into a photographic light-sensitive material preferably by incorporating into a silver halide emulsion layer but may be incorporated into the other non-light-sensitive hydrophilic colloid layers (for example, a protective layer, an intermediate layer, a filter layer, and an anti-halation layer). In the case where it is added to the silver halide emulsion layer, it may be added at an arbitrary period of when starting a chemical sensitization to before coating, and it is added preferably during a period of after finishing the chemical sensitization to before coating. In particular, it is added preferably to a coating solution prepared for coating.

The silver halide emulsion used in the present invention may have a composition of silver chloride, silver bromide, silver chlorobromide, silver iodobromide, and silver iodochlorobromide.

Various processes conventionally known in the field of a silver halide photographic light-sensitive material can be used to prepare the silver halide emulsion used in the present invention. It can be prepared by the processes described in, for example, P. Glafkides, *Chimie et Physique Photographique* (published by Paul Montel Co., 1967), G. F. Duffin, *Photographic Emulsion Chemistry* (published by The Focal Press Co., 1966), and V. L. Zelikman et al, *Making and Coating Photographic Emulsion* written by (published by The Focal Press Co., 1964).

The emulsion according to the present invention is preferably a monodispersed emulsion and has a fluctuation coefficient of 20% or less, particularly preferably 15% or less.

The grains contained in the monodispersed silver halide emulsion has an average grain size of 0.5 mm or less, particularly preferably 0.1 to 0.4 mm.

Any of a single jet process, a double jet process and the combination thereof may be used as a process for reacting a water soluble silver salt (a silver nitrate aqueous solution) with a water soluble halide. As one form of the double jet process, a process in which pAg in a liquid phase in which the silver halide is formed is maintained constant, that is, a controlled double jet process may be used. A so-called silver halide solvent such as ammonia, thioether, and tetra-substituted thiourea is preferably used to form a grain.

It is more preferably a tetra-substituted thio-urea compound and it is described in JP-A-53-82408 and 55-77737. More preferred thiourea compound is tetramethyl thiourea or 1,3-dimethyl-2-imidazolidinethione.

A silver halide emulsion having a regular crystal form and a narrow grain size distribution can readily be prepared by the controlled double jet process and a grain forming process in which a silver halide solvent is used, and they are the useful means for preparing the emulsion used in the present invention.

A monodispersed emulsion has preferably a regular crystal form such as cube, octahedron and tetradecahedron. In particular, cube is more preferred.

The silver halide grains may consist of either a phase in which the inside and surface thereof are uniform or a phase in which they are different.

In the present invention, the silver halide emulsion particularly suitable for the light-sensitive materials for photographing a line drawing and preparing a halftone dot is an emulsion prepared in the presence of an iridium salt or the complex salt thereof of $10^{-8}$ to $10^{-5}$ mole per mole of silver halide.

In the present invention, a silver halide emulsion particularly suitable for a light-sensitive material for a contact work is of silver halide comprising silver chloride of 90 mole % or more, more preferably 95 mole % or more and of silver chlorobromide or silver chloroiodobromide containing 0 to 10 mole % of silver bromide. The increase in a proportion of silver bromide or silver iodide is not preferred since a safelight safety in a daylight is deteriorated or g is lowered.

The silver halide emulsion according to the present invention may be chemically sensitized. As a method for a chemical sensitization, the known methods such as a sulfur sensitization, a selenium sensitization, a tellurium sensitization, and a noble metal sensitization can be used. They are used singly or in combination. When they are used in combination, the combinations of, for example, the sulfur sensitization and a gold sensitization, the sulfur sensitization, the selenium sensitization and the gold sensitization, and the sulfur sensitization, the tellurium sensitization and the gold sensitization are preferred.

The sulfur sensitization used in the present invention is usually carried out by adding a sulfur sensitizer and stirring an emulsion at a high temperature of 40° C. or higher for a fixed time. The conventional compounds can be used as the sulfur sensitizer. In addition to the sulfur compounds contained in gelatin, various sulfur compounds, for example, thiosulfite, thioureas, thiazoles, and rhodanine can be used. The preferred sulfur compounds include thiosulfite and a thiourea compound. An addition amount of the sulfur sensitizer is changeable under the various conditions of pH, a temperature and a size of a silver halide grain in chemical ripening, and it is preferably $10^{-7}$ to $10^{\circ}$ mole, more preferably $10^{-3}$ to $10^{-3}$ mole per mole of silver halide.

Conventional selenium compounds can be used as the selenium compound in the present invention. That is, an unstable type selenium compound is usually added and used by stirring an emulsion at an elevated temperature, preferably at 40° C. or higher for a fixed time. As the unstable selenium compound, the compounds described in JP-B-44-15748 (the term "JP-B" as used herein means an examined Japanese patent publication) and JP-B-43-13489, and JP-A-4-25832, JP-A-4-109240 and JP-A-4-324855 can be used. In particular, the compounds shown by Formulas (VIII) and (IX) in JP-A-4-324855 are preferably used.

The tellurium compound used in the present invention is a compound formed on a surface or inside of a silver halide grain in the form of silver telluride which is estimated to become a sensitizing nucleus. A generating speed of silver telluride contained in a silver halide emulsion can be tested by the method described in Japanese Patent Application No. 4-146739.

The compounds described in U.S. Pat. Nos. 1,623,499, 3,320,069, and 3,772,031, British Patents 235,211, 1,121,496, 1,295,462, and 1,396,696, Canadian Patent 800,958, JP-A-4-204640, JP-A-4-271341, JP-A-4-333043, and JP-A-4-129787, *J. Chem. Soc. Chem. Commun.* 635 (1980), 1102 (1979) and 645 (1979), *J. Chem. Soc. Perkin. Trans.*, 1,2191 (1980), *The Chemistry of Organic Selenium and Tellurium* Compounds edited by S. Patai, Vol. 11 (1986) and Vol. 12 (1987). In particular, the compounds shown by Formulas (II), (III) and (IV) in JP-A-5-313284 are preferred.

The use amounts of the selenium and tellurium sensitizers used in the present invention are changed according to the silver halide grains used and a chemical ripening condition. In general, it is used preferably in an amount of $10^{-8}$ to $10^{-2}$ mole, more preferably $10^{-7}$ to $10^{-3}$ mole per mole of silver halide.

The conditions in the chemical sensitization in the present invention are not specifically limited; pH is preferably 5 to 8; pAg is preferably 6 to 11, more preferably 7 to 10; and a temperature is preferably 40° to 95° C., more preferably 45° to 85° C.

Gold, platinum and palladium sensitizers are enumerated as the noble metal sensitizer used in the present invention, and the gold sensitization is particularly preferred. For example, chlorauric acid, potassium chloraurate, potassium aurithiocyanate, and gold sulfide are enumerated as the noble metal sensitizer used in the present invention. They are preferably used in an amount of not $10^{-7}$ to $10^{-2}$ mole per mole of silver halide.

A cadmium salt, sulfite, a lead salt, and a thallium salt may be allowed to coexist with the silver halide emulsion used in the present invention in the step of a formation or a physical ripening of the silver halide grains.

In the present invention, a reduction sensitization can be used. As a reduction sensitizer, a stannous salt, amines, formamidinesulfinic acid, and a silane compound can be used.

A thiosulfonic acid compound may be added to the silver halide emulsion according to the present invention by the method shown in European Patent 293,917.

The silver halide emulsions contained in the light-sensitive material of the present invention may be used singly or may be used in combination of two or more kinds (for example, those each having a different average grain size, those each having a different halogen composition, those each having a different crystal habit, and those each having a different chemical sensitization condition).

The silver halide photographic light-sensitive material of the present invention may contain a rhodium compound in order to achieve a high contrast and a low fog.

A water soluble rhodium compound can be used as the rhodium compound in the present invention. Examples of the rhodium compound include a rhodium (III) halide compound, or rhodium complex salts having halogen, amines or oxalate as a ligand, for example, a hexachlororhodium (III) complex salt, a hexabromorhodium (III) complex salt, a hexaamminerhodium (III) complex salt, and a trioxalatorhodium (III) complex salt. These rhodium compounds are dissolved in water or a suitable solvent to use them. A method which is usually used to stabilize a solution of the rhodium compound, that is, a method in which a hydrogen halide aqueous solution (for example, hydrochloric acid, bromic acid and hydrofluoric acid), or an alkali halide (for example, KCl, NaCl, KBr, and NaBr) is added to the solution may be used. Instead of using the water soluble rhodium compound, it is also possible to add and dissolve the different silver halide grains in which rhodium is doped in advance, during preparation of silver halide.

The total addition amount of the rhodium compounds are suitably $1\times10^{-8}$ to $5\times10^{-6}$ mole, preferably $5\times10^{-8}$ to $1\times10^{-6}$ mole per mole of silver halide finally formed.

These compounds are suitably added at the respective stages during preparation of the silver halide grains and before coating an emulsion. In particular, they are added preferably during preparation of the emulsion to incorporate them into the silver halide grains.

The silver halide photographic light-sensitive material of the present invention may contain an iridium compound in order to achieve a high sensitivity and a high contrast.

Various iridium compounds may be used in the present invention. Examples of iridium compounds include hexachloroiridium, hexaammineiridium, trioxalatoiridium, and hexacyanoiridium. These iridium compounds can be dissolved in water or a suitable solvent to use them. A method which is usually used to stabilize a solution of the iridium compound, that is, a method in which a hydrogen halide aqueous solution (for example, hydrochloric acid, bromic acid and hydrofluoric acid), or an alkali halide (for example, KCl, NaCl, KBr, and NaBr) is added to the solution may be used. Instead of use the water soluble iridium compound, it is also possible to add and dissolve the different silver halide grains in which iridium is doped in advance, during preparation of silver halide.

The total addition amount of the iridium compounds are suitably $1\times10^{-8}$ to $5\times10^{-6}$ mole, preferably $1\times10^{-8}$ to $1\times10^{-6}$ mole per mole of silver halide finally formed.

These compounds are suitably added at the respective stages during preparation of the silver halide grains and before coating an emulsion. In particular, they are added preferably during preparation of the emulsion to incorporate them into the silver halide grains.

The silver halide grains used in the present invention may contain a metal atom such as iron, cobalt, nickel, ruthenium, palladium, platinum, gold, thallium, copper, lead, and osmium. The above metals are added preferably in an amount of $1\times10^{-9}$ to $1\times10^{-4}$ mole per mole of silver halide. The above metals can be added in the form of a single salt, a double salt or a metal salt of a complex salt during preparation of the grains to incorporate them into the grains.

The silver halide grains used in the silver halide photographic light-sensitive material according to the present invention may contain at least one metal atom selected from rhenium, ruthenium and osmium. The content thereof falls preferably in the range of $1\times10^{-9}$ to $1\times10^{-5}$ mole, more preferably $1\times10^{-8}$ to $1\times10^{-6}$ mole per mole of silver. These metal atoms may be used in combination of two or more kinds. These metal atoms can be uniformly incorporated into the silver halide grains or can be incorporated so that distributions are generated in the grains as described in JP-A-63-29603, JP-A-2-306236, JP-A-3-167545, JP-A-4-76534, and JP-A-6-110146.

Rhenium, ruthenium and osmium are added in the forms of the water soluble complex salts described in JP-A-63-2042, JP-A-1-285941, JP-A-2-20852 and JP-A-2-20855. A hexaligand-complex represented by the following formula is enumerated as the particularly preferred one:

$$[ML_6]^{-n}$$

wherein M represents Ru, Re or Os, L represents a ligand and n represents 0, 1, 2, 3 or 4.

In this case, a paired ion has no importance and an ammonium or alkali metal ion is used.

There are enumerated as the preferred ligand, a halide ligand, a cyanide ligand, a cyanate ligand, a nitrosyl ligand, and a thionitrosyl ligand. Examples of the complexes used in the present invention are shown below but the present invention is not limited thereto.

| | | |
|---|---|---|
| $[ReCl_6]^{-3}$ | $[ReBr_6]^{-3}$ | $[ReCl_5(NO)]^{-2}$ |
| $[Re(NS)Br_5]^{-2}$ | $[Re(NO)Cl_5]^{-2}$ | $[Re(O)_2(NO)_4]^{-3}$ |
| $[RuCl_6]^{-3}$ | $[RuCl_4(H_2O)_2]^{-1}$ | $[RuCl_5(NO)]^{-2}$ |
| $[RuBr_5(NS)]^{-2}$ | $[Ru(CN)_6]^{-4}$ | $[Ru(CO)_3Cl_3]^{-2}$ |
| $[Ru(CO)Cl_5]^{-2}$ | $[Ru(CO)Br_5]^{-2}$ | |
| $[OsCl_6]^{-3}$ | $[OsCl_5(NO)]^{-2}$ | $[Os(NO)(CN)_5]^{-2}$ |
| $[Os(NS)Br_5]^{-2}$ | $[Os(CN)_6{}^{-4}$ | $[Os(O)_2(CN)_4]^{-4}$ |

These compounds are suitably added at the respective stages during preparation of the silver halide grains and before coating an emulsion. In particular, they are preferably added during preparation of the emulsion to incorporate them into the silver halide grains.

For incorporation of the metal complex into the silver halide grains during production of the grains, a method in which an aqueous solution dissolving a powder of the metal complex or the complex together with NaCl or KCl is added to a water soluble silver salt solution or a water soluble halide solution while preparing the grains, a method in which the metal complex is added as the third solution when a silver salt and a halide solution are added at the same time to prepare the silver halide grains by a process of simultaneously mixing the three solutions, and a method in which an aqueous solution of a necessary amount of a metal complex is placed in a reaction vessel during a grain formation can be used. In particular, the method in which the aqueous solution dissolving the metal complex powder or the complex together with NaCl or KCl is added to the water soluble halide solution is preferred.

In order to add them to a grain surface, an aqueous solution of a necessary amount of a metal complex can be put in a reaction vessel immediately after forming the grains, during the course of or after finishing a physical ripening, or during a chemical ripening.

The other heavy metal salts may be doped into the silver halide grains in the present invention. In particular, an Fe salt such as $K_4[Fe(CN)_6]$ is advantageously doped.

Further, in the present invention, the other compounds of a metal included in the VIII Group, that is, cobalt, nickel, iridium, palladium, and platinum may be used in combination. In particular, use in combination with an iridium salt such as iridium chloride and ammonium hexachloroiridate (III) is advantageous since a high sensitivity and a high contrast can be obtained.

Gelatin is advantageously used as a protective colloid for a photographic emulsion or as a binder for hydrophilic colloid layers other than the emulsion layer. In addition to gelatin, the other hydrophilic colloids can be used as well. For example, proteins such as a gelatin derivative, a graft polymer of gelatin with the other polymers, albumin, and casein; cellulose derivatives such as hydroxyethyl cellulose, carboxymethyl cellulose and cellulose sulfuric acid esters; saccharose derivatives such as sodium alginate and a starch derivative; and various synthetic hydrophilic high molecular materials such as homopolymers or co-polymers including polyvinyl alcohol, partially-acetalized polyvinyl alcohol, poly-N-vinyl-pyrrolidone, acrylic acid, polymethacrylic acid, polyacrylamide, polyvinylimidazole, and polyvinylpyrazole may be used.

In addition to lime-treated gelatin, acid-treated gelatin, a gelatin hydrolysis product and a gelatin enzymede-composed product can be used as well.

Various compounds can be incorporated into the light-sensitive material according to the present invention for the purpose of preventing a fog or stabilizing a photographic performance during manufacturing, storage or a photographic processing of the light-sensitive material. Many compounds known as an anti-fogging agent or a stabilizer such as azoles may be added into the light sensitive materials. Examples of the compounds include, for example, a benzothiazolium salt, nitroindazoles, chlorobenzimidazoles, bromobenzimidazoles, mercaptothiazoles, mercaptobenzothiazoles, mercaptothiadiazoles, aminotriazoles, benzothiazoles, and nitrobenzotriazoles; mercaptopyrimidines; mercaptotriazines; a thioketo compound such as oxazolinethione; azaindenes, for example, triazaindenes, tetraazaindenes (paricularly 4-hydroxy-substituted (1,3,3a,7)tetreaazaindenes), and pentaazaindenes; hydroquinone and the derivatives thereof; disulfides, for example, thioctic acid; benzenethiosulfonic acid, benzenesulfinic acid, and benzeneosulfonic amide. Among these compounds, preferred are benzotriazole (for example, 5-methylbenzotriazole) and nitroindazoles (for example, 5-nitroindazole). These compounds may be contained in a processing solution.

The light-sensitive material according to the present invention may contain an organic desensitizer.

The organic desensitizer has at least one water soluble group or alkali dissociating group.

These preferred organic desensitizers are exemplified in U.S. Pat. No. 4,908,293. The organic desensitizer is used in a silver halide emulsion layer suitably in an amount of $1.0\times10^{-8}$ to $1.0\times10^{-4}$ mole/m$^2$, preferably $1.0\times10^{-7}$ to $1.0\times10^{-5}$ mole/m$^2$.

The light-sensitive material of the present invention may contain a developing accelerator.

As the developing accelerator or an accelerator for a nucleus-forming infectious development suitably used in the present invention, compounds containing an N or S atom are effective as well as the compounds disclosed in JP-A-53-77616, JP-A-54-37732, JP-A-53-137,133, JP-A-60-140,340, and JP-A-60-14959.

Specific examples of the accelarator are shown below.

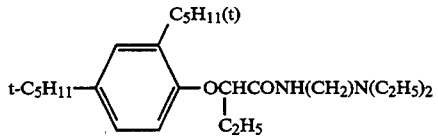

(1)

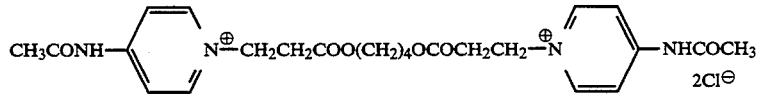

(2)

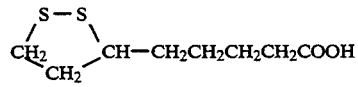

(3)

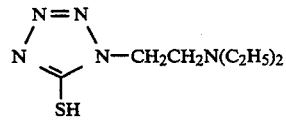

(4)

-continued
(5)
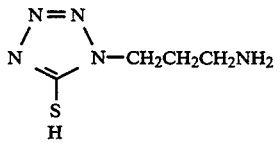
(6)
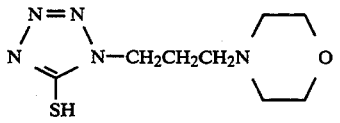
(7)
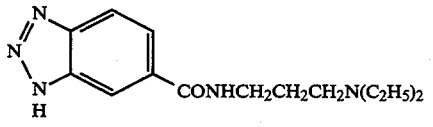
(8)
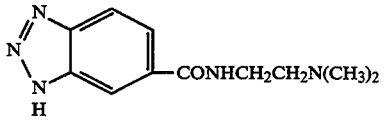
(9)
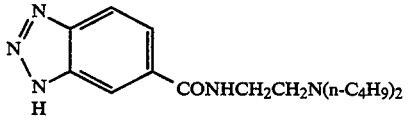
(10)
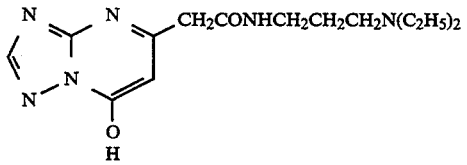
(11)
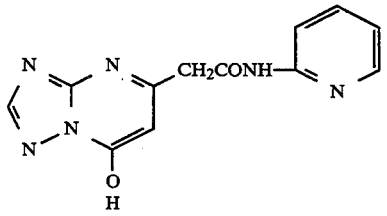
(12)
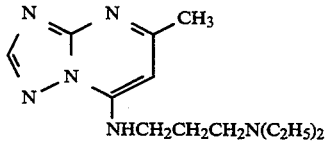
(13)
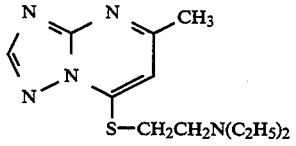
(14)
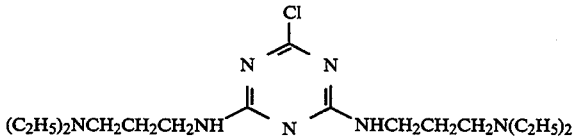
(15)
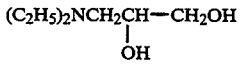

-continued $n\text{-}C_4H_9N(C_2H_4OH)_2$ (16)

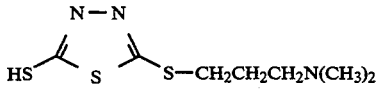

(17)

These accelerators have a different optimum addition amount according to the type of the compounds and are desirably used in a range of $1.0\times10^{-3}$ to 0.5 g/m$^2$, preferably $5.0\times10^{-3}$ to 0.1 g/m$^2$. These accelerators are dissolved in a suitable solvent (for example, water, alcohols such as methanol and ethanol, acetone, dimethylformamide, and methyl cellosolve) to add them into a coating solution.

These additives may be used in combination of plural kinds.

The emulsion layers and other hydrophilic colloid layers in the light-sensitive material of the present invention may contain a water soluble dye as a filter dye or for the various purposes of irradiation prevention and others. There are used as the filter dye, a dye for further lowering a photographic sensitivity, preferably a UV absorber having a spectral absorption maximum in an intrinsic sensitive region of silver halide and a dye having a substantial light absorption primarily in a region of 310 nm to 600 nm for raising a safety against a safelight in handling a daylight light-sensitive material.

According to a purpose these dyes are preferably added to an emulsion layer or an .upper part of a silver halide emulsion layer, that is, a non-light-sensitive hydrophilic colloid layer farther from a support than the silver halide emulsion layer together with a mordant to fix them.

An addition amount of the dye is different according to a molar extinction coefficient, and it is added usually in a range of $10^{-3}$ g/m$^2$ to 1 g/m$^2$, preferably 10 mg to 500 mg/m$^2$.

The above-described dyes can be dissolved in a suitable solvent [for example, water, alcohol (for example, methanol, ethanol and propanol), acetone, and methyl cellosolve, or the mixed solvent thereof) to add them to a coating solution.

These dyes can be used in combination of two or more kinds of the dyes.

Examples of these dyes are described in U.S. Pat. No. 4,908,293. In addition thereto, the UV absorbers described in U.S. Pat. Nos. 3,533,794, 3,314,794, and 3,352,681, JP-A-46-2784, U.S. Pat. Nos. 3,705,805, 3,707,375, 4,045,229, 3,700,455, and 3,499,762, and German Paten Publication 1,547,863 may also be used.

In addition to the above, the pyrazolone oxonol dyes described in U.S. Pat. No. 2,274,782, the diarylazo dyes described in U.S. Pat. No. 2,956,879, the styryl dyes and the butadienyl dyes described in U.S. Pat. Nos. 3,423,207 and 3,384,487, the merocyanine dyes described in U.S. Pat. No. 2,527,583, the merocyanine dyes and the oxonol dyes described in U.S. Pat. Nos. 3,486,897, 3,652,284 and 3,718,472, the enaminohemioxonol dyes described in U.S. Pat. No. 3,976,661, and the dyes described in British Patents 584,609 and 1,177,429, JP-A-48-85130, JP-A-49-99620, and JP-A-49-114420, and U.S. Pat. Nos. 2,533,472, 3,148,187, 3,177,078, 3,247,127, 3,540,887, 3,575,704, and 3,653,905 may also be used.

An inorganic or organic hardener may be incorporated into a photographic emulsion layer and the other hydrophilic colloid layers in the photographic light-sensitive material according to the present invention.

Examples of the hardener include a chromium salt (chromium alum and chromium acetate), aldehydes (formaldehyde, glyoxal and glutaraldehyde), an N-methylol compound (dimethylolurea and methyloldimethylhydantoin), a dioxane derivative (2,3-dihydroxydioxane), an active vinyl compound (1,3,5-triacryloyl-hexahydro-s-triazine and 1,3-vinylsulfonyl-2-propanol), an active halogen compound (2,4-dichloro-6-hydroxy-s-triazine), mucohalogenic acids (mucochloric acid and muchophenoxychloric acid), an epoxy compound (tetamethylene glycol diglycidyl ether), and an isocyanate compound (hexamethylenediisocyanate). These compounds may be used singly or in combination.

Further, the polymer hardeners described in JP-A-56-6841, British Patent 1,322,971, and U.S. Pat. No. 3,671,256 may also be used.

The photographic emulsion layers and other hydrophilic colloid layers of the light-sensitive material of the present invention may contain various surface active agents for various purposes such as a coating aid, an anti-electrification, an improvement in a sliding performance, an emulsification-dispersion, an anti-sticking, and an improvement in the photographic characteristics (for example, development acceleration, harder gradation and sensitization).

Examples of the surface active agent include a nonionic surface active agent such as saponin (asteroid series), an alkylene oxide derivative (for example, polyethylene glycol, a polyethylene glycol/polypropylene glycol condensation product, polyethylene glycol alkyl ethers or polyethylene glycol alkyl aryl ethers, polyethylene glycol esters, polyethylene glycol sorbitan esters, polyalkylene glycol alkylamines or amides, and polyethylene oxide adducts of silicon), a glycidol derivative (for example, alkenylsuccinic acid polyglyceride and alkylphenol polyglyceride), fatty acid esters of polyhydric alcohol, and alkyl esters of succharose; an anionic surface active agent having an acid group such as a carboxy group, a sulfo group, a phospho group, a sulfuric acid ester group and a phosphoric acid ester group, such as an alkylcarbonic acid salt, an alkylsulfonic acid salt, an alkylbezenesulfonic acid salt, an alkylnaphtalenesulfonic acid salt, alkylsulfuric acid esters, alkylphosphoric acid esters, N-acyl-N-alkyltaurines, sulfosuccinic acid esters, sulfoalkyl polyoxyethylenealkylphenyl ethers, and polyoxyethylene alkylphosphoric acid esters; an amphoteric surface active agent such as amino acids, aminoalkylsulfonic acids, aminoalkylsulfuric acid or phosphoric acid esters, alkylbetains, and amine oxides; and a cationic surface active agent such as alkylamine salts, aliphatic or aromatic quaternary ammonium salts, pyridinium, heterocyclic quaternary ammonium salts such as imidazolium, and aliphatic or heterocycle-containing phosphonium or sulfonium salts.

The surface active agents particularly preferably used in the present invention are polyalkylene oxides having a molecular weight of 600 or more, described in JP-B-58-9412. Further, a polymer latex such as polyalkyl acrylate can be incorporated for a dimensional stabilization.

A developing agent used for a developing solution used in the present invention is not specifically limited, and dihydroxybenzenes are preferably incorporated in terms of easily obtaining a good halftone dot quality. In some cases, a combination of dihydroxybenzenes and 1-phenyl-3-pyrazolidones or a combination of dihydroxybenzenes and p-aminophenols are used.

Preferred dihydroxybenzene developing agent used in the present invention are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Hydroquinone is particularly preferred.

The 1-phenyl-3-pyrazolidone developing agent or the derivative thereof used in the present invention includes 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The p-aminophenol developing agent used in the present invention includes N-methyl-p-aminophenol, p-aminophenol, N-(β-hydroxyethyl)-p-aminophenol, N-(4-hydroxyphenyl)glycine, 2-methyl-p-aminophenol, and p-benzyl aminophenol. Among them, N-methyl-p-amino-phenol is preferred.

Usually, the developing agent is used preferably in an amount of 0.05 to 0.8 mol/liter. In the case where the combination of dihydroxybenzenes and 1-phenyl-3-pyrazolidones or p-aminophenols is used, the former is used preferably in an amount of 0.05 to 0.5 mol/liter and the latter in an amount of 0.06 mol/liter or less.

Sulfites used as a preservative in the present invention include sodium sulfite, potassium sulfite, lithium sulfite, ammonium sulfite, sodium bisulfite, potassium metabisulfite, and sodium formaldehyde bisulfite. Sulfites are added preferably in an amount of 0.3 mole/liter or more, particularly preferably 0.4 mole/liter or more. The preferred upper limit thereof is 2.0 mole/liter, particularly preferably 1.2 mole/liter.

Examples of an alkali agent used for settling pH includes a pH controlling agent and a buffer agent such as sodium hydroxide, potassium hydroxide, sodium carbonate, potassium carbonate, sodium tertiary phosphate, potassium tertiary phosphate, sodium silicate, and potassium silicate.

There may be contained as the additives used in addition to the compounds described above, a development inhibitor such as boric acid and borax, sodium bromide, potassium bromide, and potassium iodide; an organic solvent such as ethylene glycol, diethylene glycol, triethylene glycol, dimethylformamide, methyl cellosolve, hexylene glycol, ethanol, and methanol; and an anti-fogging agent such as a mercapto series compound including 1-phenyl-5-mercaptotetrazole and sodium 2-mercaptobenzimidazole-5-sulfonate, an indazole series compound including 5-nitroindazole, and a benzotriazole series compound including 5-methylbenzotriazole. Further, there may be contained, if desired, a color toning agent, a surface active agent, a defoaming agent, a softening agent for hard water, a hardener, and a stabilizer. In particular, the amino compounds described in JP-A-56-106244 and the imidazole compounds described in JP-B-48-35493 are preferred in terms of a development acceleration or a sensitivity increase.

The developing solution used in the present invention, may contain the compounds described in JP-A-56-24347 and JP-A-4-362942 as an anti-silver stain agent, the compounds described in JP-A-62-212651 as an anti-uneven development agent, the compounds described in JP-A-61-267759 as a dissolution aid, and ascorbic acids as a stabilizer.

As a buffer agent for the developing solution used in the present invention, boric acid described in JP-A-62-186259, sugars (for example, succharose) described in JP-A-60-93433, oximes (for example, acetoxime), phenols (for example, 5-sulfosalicylic acid), and tertiary phosphate (for example, a sodium salt and a potassium salt) may be used. Boric acid is preferably used.

A fixing solution is an aqueous solution which may contain a hardener (for example, a water soluble aluminum compound), acetic acid and dibasic acid (for example, tartaric acid, citric acid, and the salts thereof) in addition to a fixing agent, and has preferably pH of 3.8 or more, more preferably 4.0 to 5.5.

Examples of the fixing agent include sodium thiosulfate and ammonium thiosulfate, and ammonium thiosulfate is particularly preferred from a viewpoint of a fixing speed. A use amount of the fixing agent can arbitrarily be changed. In general, it is about 0.1 to about 5 mole/liter.

A water soluble aluminum salt which acts primarily as a hardener in the fixing solution is a compound which is generally known as a hardener for an acidic hardening fixing solution, and includes, for example, aluminum chloride, aluminum sulfate, and potassium alum.

Tartaric acid or the derivative thereof and citric acid or the derivative thereof can be used singly or in combination of two or more kinds thereof as the dibasic acid described above. The fixing solution containing these compounds in an amount of 0.005 mole or more per liter of the fixing solution is effective. Particularly effective is the solution containing them in an amount of 0.01 to 0.03 mole per liter of the fixing solution.

To be concrete, there are included tartaric acid, potassium tartarate, sodium tartarate, potassium sodium tartarate, ammonium tartarate, and ammonium potassium tartarate.

Citric acid, sodium citrate, and potassium citrate are included in the examples of citric acid or the derivative thereof which is effective in the present invention.

The fixing solution can further contain a preservative (for example, sulfite and bisulfite), a pH buffer agent (for example, acetic acid and boric acid), a pH controlling agent (for example, ammonia and sulfuric acid), an image preservation improver (for example, potassium iodide), and a chelating agent, if desired. The pH buffer agent is used in an amount of 10 to 40 g/liter, more preferably 18 to 25 g/liter since pH of a developing solution is high.

A fixing temperature and time are the same as those for a development, and about 20° to about 50° C. and 10 seconds to 1 minute are preferred, respectively.

Washing water may contain an anti-mold agent (for example, the compounds described in *Anti-fungus Anti-Mold Chemistry* written by Horiguchi and JP-A-62-

115154), a washing accelerator (sulfite), and a chelating agent.

According to the processes described above, a photographic material developed and fixed is washed and dried. Washing is carried out in order to almost completely remove a silver salt dissolved by fixing and carried out preferably at about 20° to about 50° C. for 10 seconds to 3 minutes. Drying is carried out at about 40° to about 100° C. The drying time is arbitrarily changed according to an environmental condition and is usually about 5 seconds to 3 minutes and 30 seconds.

A roller transporting type automatic developing machine is described in U.S. Pat. Nos. 3,025,779 and 3,545,971. It is referred to simply as a roller transporting type processor in the instant specification. The roller transporting type processor consists of the four processes of developing, fixing, rinsing and drying. In the present invention, the other processes (for example, a stopping process) are not excluded but these four processes are most preferably followed. In this case, a 2 to 3 stages countercurrent system can be used as the washing process to carry out a water saving processing.

The developing solution used in the present invention is stored preferably in a packing material having a low oxygen permeability described in JP-A-61-73147. Further, a replenishing system described in 62-91939 can be used for the developing solution used in the present invention.

Various additives used for the light-sensitive material of the present invention are not specifically limited, and those described in, for example, the corresponding portions shown below can preferably be used:

| Item | Corresponding portion |
|---|---|
| 1) Spectrally sensitizing dye | pp. 8, left lower column, line 13 to right lower column, line 4 of JP-A−2-12236; pp. 16, right lower column, line 3 to pp. 17, left lower column, line 20 of JP-A-2-103536; and further the spectral sensitizing dyes described in JP-A-1-112235, JP-A-2-124560, JP-A-3-7928, and JP-A-5-11389. |
| 2) Nucleus-forming accelerator | the compounds of Formulas (I), (II), (III), (IV), (V) and (VI), described in JP-A-6-82943; Formulas (II-m)-to (II-p) and the compounds II-1 to II-22 at pp. 9, right upper column, line 13 to pp. 16, left upper column, line 10 of JP-A-2-103536; and the compounds described in JP-A-1-179939. |
| 3) Surface active agent and anti-static agent | pp. 9, right upper column, line 7 to right lower column, line 7 of JP-A-2-12236; and pp. 2, left lower column, line 13 to pp. 4, right lower column, line 18 of JP-2-18542. |
| 4) Anti-fogging agent and atabilizer | pp. 17, right lower column, line 19 to pp. 18, right upper column, line 4, and right lower column, lines 1 to 5 of JP-A-2-103536; and further the thio- |

-continued

| Item | Corresponding portion |
|---|---|
| | sulfinic acid compounds described in JP-A-1-237538. |
| 5) Polymer latex | pp. 18, left lower column, lines 12 to 20 of JP-A-2-103536. |
| 6) Compound having an acid group | pp. 8, right lower column, line 5 to pp. 19, left upper column, line 1 of JP-A-2-103536; and pp. 8, right lower column, line 13 to pp. 11, left upper column, line 8 of JP-A-2-55349. |
| 7) Matting agent, sliding agent and plasticizer | pp. 19, left upper column, line 15 to right upper column, line 15 of JP-A-2-103536. |
| 8) Hardener | pp. 18, right upper column, lines 5 to 17 of JP-A-2-103536. |
| 9) Dye | pp. 17, right lower column, lines 1 to 18 of JP-A-2-103536, pp. 4, right upper column, line 1 to pp. 6, right upper column, line 5 of JP-A-2-39042; and solid dyes described in JP-A-2-294638 and JP-A-5-11382. |
| 10) Binder | pp. 3, right lower column, lines 1 to 20 of JP-A-2-18542. |
| 11) Anti-black speck agent | the compounds described in U.S. Pat. 4,956,257, and JP-A-1-118832. |
| 12) Redox compound | the compounds represented by Formula (I) (particularly the compound examples 1 to 50) in JP-A-2-301743; Formulas (R-1), (R-2) and (R-3) and the compound examples 1 to 75 described at pp. 3 to 20 of JP-A-3-174143; and further the compounds described in JP-A-5-257239 and JP-A-4-278939. |
| 13) Monomethine compound | the compounds of Formula (II) (particularly the compound examples II-1 to II-26) described in JP-A-2-287532. |
| 14) Dihydroxybenzenes | pp. 11, left upper column to pp. 12 left lower column-of JP-A-3-39948; and the compounds described in European Patent 452,772A. |

EXAMPLE 1

1) Preparation of a coated sample:

After a silver nitrate aqueous solution and a sodium chloride aqueous solution were simultaneously added to a gelatin aqueous solution maintained at 40° C. under the presence of $NH_4RhCl_6$ of $5.0\times10^{-6}$ mole per mole of silver, soluble salts were removed by the method well known in the art, and then gelatin was added to the mixture. Then, 2-methyl-4-hydroxy-1,3,3a,7-tetrazaindene was added as a stabilizer without providing a chemical sensitization. This emulsion was a monodispersed emulsion with a cubic crystal form having the average grain size of 0.2μ.

The hydrazine compounds represented by Formula (I) and the comparative compounds were added to this emulsion, respectively, as shown in Table 1.

Comparative compound A (the compound I-6 described in U.S. Pat. No. 4,988,604)

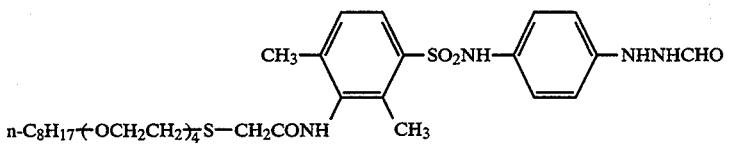

Comparative compound B (the compound I-6 described in U.S. Pat. No. 4,994,365)

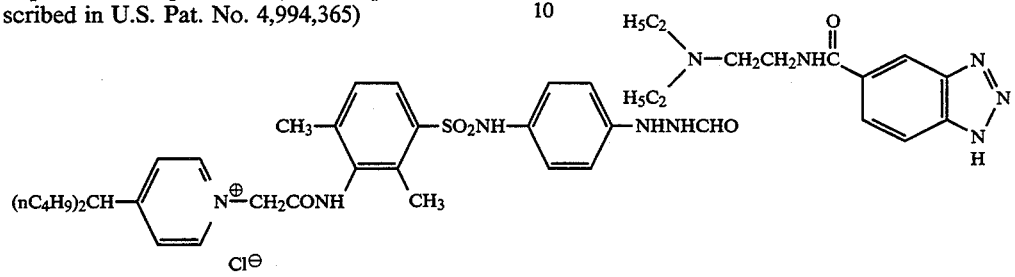

Comparative compound C

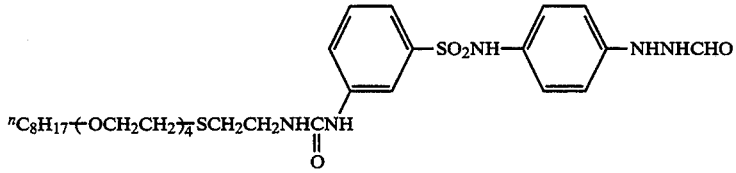

Comparative compound D

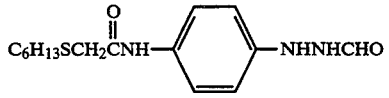

Comparative compound E (the compound included in the formula described in JP-A-3-259240)

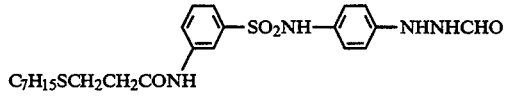

Further, 15 mg/m$^2$ of the following nucleus-forming agent was added:

Further, a polyethylacrylate latex was added in a proportion of 30 wt % based on gelatin in terms of a solid matter and 1,3-divinylsulfonyl-2-propanol was added as a hardener, followed by coating on a polyester support so that an Ag amount became 3.8 g/m$^2$. Gelatin was 1.8 g/m$^2$. A layer comprising 1.5 g/m$^2$ of gelatin 1.5 g/m$^2$ and 0.3 g/m$^2$ of polymethylmethacrylate having a grain size of 2.5$\mu$ was coated thereon as a protective layer.

The base used in the present invention has a back layer and a back protective layer each having the following composition (a swelling rate on a back side is 110%).

| | |
|---|---|
| Back layer: | |
| Gelatin | 170 mg/m$^2$ |
| Sodium dodecylbenzenesulfonate | 32 mg/m$^2$ |
| Sodium dihexyl-$\alpha$-sulfosuccinate | 35 mg/m$^2$ |
| $SnO_2$/Sb (9/1 weight ratio, average grain size: 0.25 $\mu$m) | 318 mg/m$^2$ |
| Back protective layer: | |
| Gelatin | 2.7 g |
| Silicon dioxide matting agent (average grain size: 3.5 $\mu$m) | 26 mg/m$^2$ |
| Sodium dihexyl-$\alpha$-sulfosuccinate | 20 mg/m$^2$ |
| Sodium dodecylbenzenesulfonate | 67 mg/m$^2$ |
| $C_8F_{17}SO_2N(C_3H_7)-(CH_2CH_2O)_n-(CH_2)_4-SO_3Li$ | 5 mg/m$^2$ |

Dye A

-continued

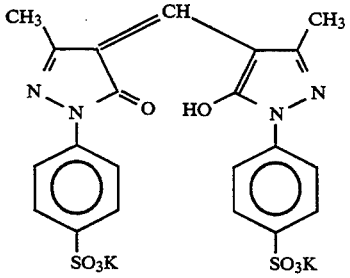

190 mg/m²

Dye B

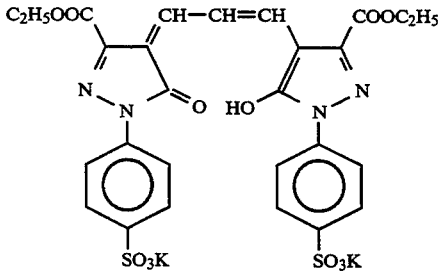

32 mg/m²

Dye C

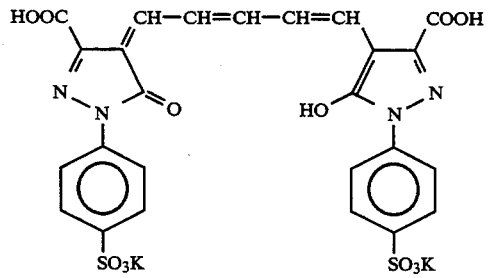

59 mg/m²

| | |
|---|---|
| Ethyl acrylate latex (average grain size: 0.05 μm) | 260 mg/m² |
| 1,3-Divinylsulfonyl-2-propanol | 149 mg/m² |
| Developing solution A: | |
| Potassium hydroxide | 90.0 g |
| Sodium hydroxide | 8.0 g |
| Sodium ethylenediaminetetraacetate | 1.0 g |
| Boric acid | 24.0 g |
| Sodium metabisulfite | 65.0 g |
| Potassium bromide | 10.0 g |
| Hydroquinone | 55.0 g |
| 5-Methylbenzotriazole | 0.40 g |
| N-methyl-p-aminophenol | 0.50 g |
| Sodium 2-mercaptobenzimidazole-6-sulfonate | 0.30 g |
| Sodium 3-(5-mercaptotetrazole) benzene-sulfonate | 0.20 g |
| N-n-butyl-diethanolamine | 14.0 g |
| N,N-dimethylamino-6-hexanol | 0.20 g |
| Sodium tolenesulfonate | 8.0 g |
| 5-Sulfosalicylic acid | 23.0 g |
| Potassium hydroxide was added and water was added to | 1 liter, and |
| pH was adjusted to | 11.9 |

2) Evaluation of a photographic performance:

The coated samples thus obtained were subjected to an imagewise exposure with the daylight printer model P-27FM avairable from Dainippon Screen Co., Ltd. through the original shown in FIG. 1 of JP-A-2-293736 (corresponding to FIG. 1 of U.S. Pat. No. 5,124,230). The exposed samples were subjected to a development processing with the automatic developing machine model FG10NH avairable from Fuji Photo Film Co., Ltd. in the developing solution A at 34° C. for 20 seconds and then to a fixing processing in the fixing solution GR-F1 avairable from Fuji Photo Film Co., Ltd., followed by washing with water and drying.

The results of the evaluations of a superimposed letter image quality and Dmax of the respective samples were shown in Table 1. The superimposed letter image quality 5 means an image quality in which a character with a 30 μm width is reproduced when an optimum exposure is given with the original shown in FIG. 1 described above so that a halftone dot area of 50% becomes a halftone dot area of 50% on a light-sensitive material for a dot to dot work, and it shows a very good loose character image quality. Meanwhile, the superimposed letter image quality 1 means an image quality in which when an optimum exposure is similarly given, only a character with a 150 μm or more width can be reproduced, and it is an inferior loose character image quality. The ranks of 2 to 4 were put between 5 and 1 by a visual observation. The rank of 3 or higher is a practicable level.

Similarly, Dmax is obtained when exposure is given so that a halftone dot area of 50% becomes a halftone dot area of 50% on the light-sensitive material for a dot to dot work.

The samples of the present invention provides high Dmax with a little amount of a nucleus-forming agent and has an excellent superimposed letter image quality.

TABLE 1

| | Sample No. | Compound | Added amount (mol/Ag mol) | Dmax | Loose character image quality |
|---|---|---|---|---|---|
| 1 | 1-a (Comp.) | A (Comp.) | $1.5 \times 10^{-3}$ | 3.3 | 4 |
| 2 | 1-b (Comp.) | C (Comp.) | $1.5 \times 10^{-3}$ | 3.6 | 3 |
| 3 | 1-c (Comp.) | C (Comp.) | $2.0 \times 10^{-4}$ | 2.9 | 3 |
| 4 | 1-1 (Inv.) | I-6 | $2.0 \times 10^{-4}$ | 4.2 | 5 |
| 5 | 1-2 (Inv.) | I-10 | $2.0 \times 10^{-4}$ | 4.1 | 5 |
| 6 | 1-3 (Inv.) | I-11 | $2.0 \times 10^{-4}$ | 4.0 | 5 |
| 7 | 1-4 (Inv.) | I-14 | $2.0 \times 10^{-4}$ | 4.0 | 5 |
| 8 | 1-5 (Inv.) | I-26 | $2.0 \times 10^{-4}$ | 4.1 | 5 |
| 9 | 1-6 (Inv.) | I-29 | $2.0 \times 10^{-4}$ | 4.0 | 5 |

3) Photographic performance obtained by processing in a fatigued developing solution:

The developing solution A was charged into the automatic developing machine FG710NH and the machine was operated at 38° C. for 8 hours per day without passing a film, and the performances obtained when a development processing was carried out after 5 days were shown in Table 2.

ΔD is a difference of the value of Dmax in Table 2 from the value of Dmax in Table 1. The samples of the present invention has a small fluctuation in Dmax.

TABLE 2

| | Sample No. | Dmax | ΔDmax | Loose character image quality |
|---|---|---|---|---|
| 1 | 1-a (Comp.) | 2.5 | −0.8 | 5 |
| 2 | 1-b (Comp.) | 3.4 | −0.2 | 5 |
| 3 | 1-c (Comp.) | 2.5 | −0.4 | 4 |
| 4 | 1-1 (Inv.) | 4.1 | −0.1 | 5 |
| 5 | 1-2 (Inv.) | 4.0 | −0.1 | 5 |
| 6 | 1-3 (Inv.) | 3.8 | −0.2 | 5 |
| 7 | 1-4 (Inv.) | 3.8 | −0.2 | 5 |
| 8 | 1-5 (Inv.) | 4.0 | −0.1 | 5 |
| 9 | 1-6 (Inv.) | 3.8 | −0.2 | 5 |

EXAMPLE 2

Preparation of a light-sensitive emulsion:

A silver nitrate aqueous solution and an aqueous solution of potassium iodide and potassium bromide were simultaneously added to a gelatin aqueous solution maintained at 50° C. over the period of 60 minutes under the presence of potassium hexachloroiridate (III) of $4\times10^{-7}$ mole per mole of silver and ammonia, and pAg was maintained at 7.8 during the addition of the solutions, whereby a cubic monodispersed emulsion having an average grain size of 0.28μ and an average silver iodide content of 0.3 mole % was prepared. This emulsion was desalted by a flocculation process and then inactive gelatin of 40 g per mole of silver was added. Thereafter, while maintaining at 50° C., there were added 5,5'-dichloro-9-ethyl-3,3-bis(3-sulfopropyl-)oxacarbocyanine as a sensitizing dye and a KI solution of $10^{-3}$ mole per mole of silver. The emulsion was aged for 15 minutes and then the temperature was lowered.

Coating of a light-sensitive emulsion layer:

This emulsion was dissolved once again, and the compounds of the present invention and the comparative compounds each shown in Table 3 were added at 40° C. Further added were 5-methylbenzotriazole, 4-hydroxy-1,3,3a,7-tetrazaindene, the following compound (a), polyethylacrylate of 30 wt % based on gelatin, and the following compound (b) as a gelatin hardener. The solution thus prepared was coated on a polyethylene terephthalate support (150μ) comprising a vinylidene chloride copolymer and having a subbing layer (0.5μ) so that a silver amount became 3.8 g/m².

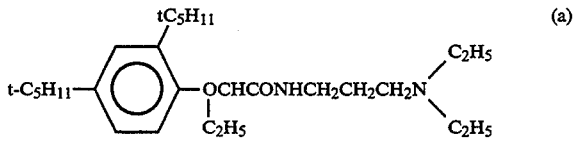

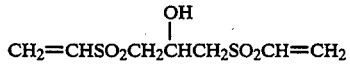

2.0 wt. % based on gelatin

Coating of a protective layer:

A protective layer was coated thereon using the following surface active agent so that gelatin, the polymethylmethacrylate grains (average grain size: 2.5μ) and the AgCl fine grains prepared by the following process became 1.5 g/m², 0.3 g/m² and 0.3 g/m², respectively, in terms of an Ag amount.

Surface active agents

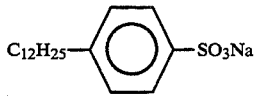

37 mg/m²

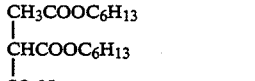

37 mg/m²

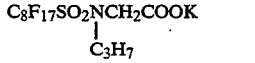

2.5 mg/m²

The back layer and the back protective layer were coated with the compositions shown below:

| Back layer composition: | |
|---|---|
| Gelatin | 3 g/m² |
| Latex polyethylacrylate | 2 g/m² |
| Surface active agent sodium p-dodecylbenzenesulfonate | 40 g/m² |

-continued

| | |
|---|---|
| $CH_2{=}CHSO_2CH_2CONH{-}$ ┐ $(CH_2)_2$ ┘ $CH_2{=}CHSO_2CH_2CONH{-}$ | 100 mg/m$^2$ |
| $SnO_2$/Sb (90/10 weight ratio, average grain size: 0.20 μm) | 200 mg/m$^2$ |
| Mixture of dye [a], dye [b] and dye [c] | |
| Dye [a] | 50 mg/m$^2$ |
| Dye [b] | 100 mg/m$^2$ |
| Dye [c] | 50 mg/m$^2$ |

Dye [a]

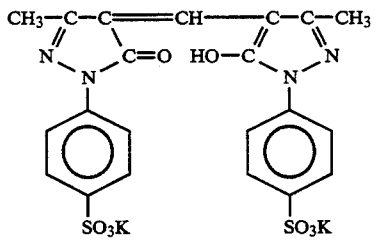

Dye [b]

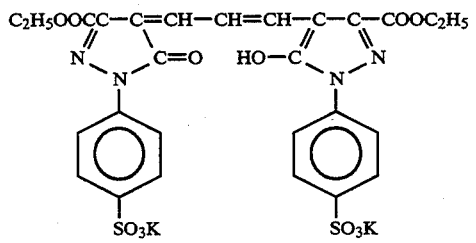

Dye [c]

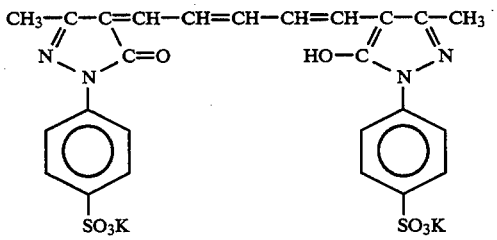

| Back Protective layer: | |
|---|---|
| Gelatin | 0.8 mg/m$^2$ |
| Polymethylmethacrylate fine grains (average grain size: 4.5 μm) | 30 mg/m$^2$ |
| Sodium dihexyl-α-sulfosuccinate | 15 mg/m$^2$ |
| Sodium p-dodecylbenzenesulfonate | 15 mg/m$^2$ |
| Sodium acetate | 40 mg/m$^2$ |

Evaluation of the performances:

These samples were exposed to a tungsten light of 3200° K. through an optical wedge and a contact screen (a 150L chain dot type avairable from Fuji Photo Film Co., Ltd.), and then they were developed in the developing solution A at 34° C. for 30 seconds, fixed, washed, and dried.

The measuring results of a halftone dot quality and Dmax of the samples thus obtained are shown in Table 3.

TABLE 3

| | Sample No. | Compound | Added amount (mol/Ag mol) | Dmax | Half-tone dot quality |
|---|---|---|---|---|---|
| 1 | 2-a (Comp.) | A (Comp.) | 0.8 × 103 | 2.2 | 3 |
| 2 | 2-b (Comp.) | E (Comp.) | $0.8 \times 10^{-3}$ | 2.8 | 3 |
| 3 | 2-c (Comp.) | E (Comp.) | $1.0 \times 10^{-4}$ | 1.7 | 2 |
| 4 | 2-1 (Inv.) | I-6 | $1.0 \times 10^{-4}$ | 4.1 | 5 |
| 5 | 2-2 (Inv.) | I-10 | $1.0 \times 10^{-4}$ | 4.0 | 5 |
| 6 | 2-3 (Inv.) | I-11 | $1.0 \times 10^{-4}$ | 3.9 | 4 |
| 7 | 2-4 (Inv.) | I-14 | $1.0 \times 10^{-4}$ | 3.8 | 4 |
| 8 | 2-5 (Inv.) | I-26 | $1.0 \times 10^{-4}$ | 3.9 | 5 |
| 9 | 2-6 (Inv.) | I-29 | $1.0 \times 10^{-4}$ | 3.8 | 4 |

The halftone dot quality was visually evaluated by five grades. In the five grade evaluation, "5" shows the best quality and "1" shows the worst quality. "5" and "4" are practicable as a halftone dot original for a plate making and "3" resides at a practicable limit level. "2" and "1" show an impracticable quality.

Dmax was shown by an optical density (Dmax) at a point where an exposure was given more by 0.5 (0.5+log E3) than an exposure (log E3) providing an optical density of 1.5 in the samples which were similarly subjected to exposing and development processing through an optical wedge.

It can be found that use of the compounds of the present invention allows high Dmax to be maintained and provides a high halftone dot quality as compared with the comparative compounds.

EXAMPLE 3

Preparation of the image forming layer emulsion:

A 0.37M silver nitrate aqueous solution and a halide aqueous solution containing $K_2Rh(H_2O)Cl_5$ in an amount of $1\times10^{-7}$ mole and $K_2IrCl_6$ in an amount of $2\times10^{-7}$ mole each per mole of silver, 0.16M potassium bromide, and 0.22M sodium chloride were added to a 2% gelatin aqueous solution containing 0.08M sodium chloride and 1,3-dimethyl-2-imidazolinethione by a double jet method at 38° C. for 12 minutes while stirring, whereby the silver chlorobromide grains having an average grain size of 0.20 μm and the silver chloride content of 55 mole % were obtained to thereby form the nuclei. Subsequently, a 0.63M silver nitrate aqueous solution and a halide aqueous solution containing 0.23M potassium bromide and 0.43M sodium chloride were similarly added by the double jet method over the period of 20 minutes. Then, a KI solution of $1\times10^{-3}$ mole per mole of silver was added to carry out a conversion and washing was carried out by a flocculation method according to a conventional method, followed by adding gelatin 40 g per mole of silver and adjusting pH and pAg to 6.0 and 7.3, respectively. Further, there were added 7 mg of sodium benzenethiosulfonate, 2 mg of benzenesulfinic acid, 8 mg of chlorauric acid, and 5 mg of sodium thiosulfate each per mole of silver, and heated at 60° C. for 45 minutes to provide a chemical sensitization, followed by adding 150 mg of 4-hydroxy-6-methyl-1,3,3a,7-tetrazaindene as a stabilizer and Proxel as a preservative. The grains thus obtained were the silver chlorobromide cubic grains having an average grain size of 0.27 μm and a silver chloride content of 60 mole % (fluctuation coefficient: 10%).

There was added as a sensitizing dye to the emulsion thus obtained, $7\times10^{-4}$ mole per mole silver of potassium 5-[3-(4-sulfobutyl)-5-chloro-2-benzoxazolidilidene]ethylidene-1-hydroxyethoxyethyl-3-(2-pyridyl)-2-thiohydantoin. Further added were $4\times10^{-4}$ mole of the short wave cyanine dye represented by the following structural formula (A), $3\times10^{-4}$ mole of 1-phenyl-5-mercaptotetrazole, $4\times10^{-4}$ mole of the mercapto compound represented by the following structural formula (B), $3\times10^{-4}$ mole of the mercapto compound represented by the following structural formula (C), $4\times10^{-4}$ mole of the triazine compound represented by the following structural formula (D), $2\times10^{-3}$ mole of 5-chloro-8-hydroxyquinoline, the hydrazine compound of the present invention as shown in Table 4, and further 30 mg/m$^2$ of sodium N-oleyl-N-methyltaurine. There were added thereto, the dispersion of polyethylacrylate (500 mg/m$^2$) and 1,2-bis(-vinylsulfonylacetoamido)ethane (30 mg/m$^2$) as a hardener, whereby the image-forming layer coating solution was prepared.

(A)

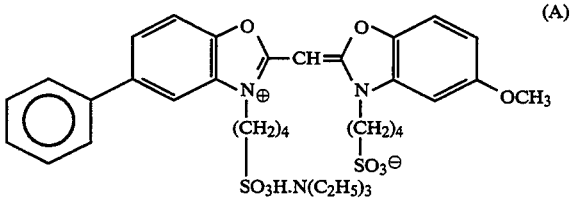

(B)

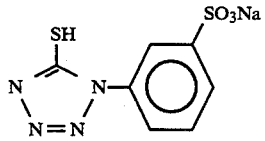

(C)

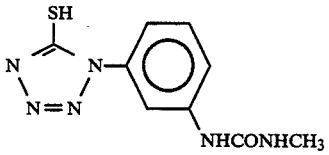

(D)

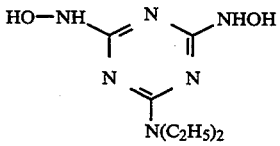

TABLE 4

| | Sample | Compound | Added amount (mol/Ag mol) |
|---|---|---|---|
| 1 | 3-a (Comp.) | A (Comp.) | $1.0\times10^{-3}$ |
| 2 | 3-b (Comp.) | B (Comp.) | $1.0\times10^{-3}$ |
| 3 | 3-c (Comp.) | C (comp.) | $1.0\times10^{-3}$ |
| 4 | 3-d (Comp.) | D (Comp.) | $1.0\times10^{-3}$ |
| 5 | 3-e (Comp.) | E (Comp.) | $1.0\times10^{-3}$ |
| 6 | 3-1 (Inv.) | I-6 | $4.0\times10^{-4}$ |
| 7 | 3-2 (Inv.) | I-10 | $4.0\times10^{-4}$ |
| 8 | 3-3 (Inv.) | I-11 | $4.0\times10^{-4}$ |
| 9 | 3-4 (Inv.) | I-14 | $4.0\times10^{-4}$ |
| 10 | 3-5 (Inv.) | I-26 | $4.0\times10^{-4}$ |
| 11 | 3-6 (Inv.) | I-29 | $4.0\times10^{-4}$ |

Preparation of the emulsion for redox compound-containing layer:

A 1.0M silver nitrate aqueous solution and a halide aqueous solution containing $(NH_4)_3RhCl_6$ in an amount of $3\times10^{-7}$ mole per mole of silver, 0.3M potassium bromide, and 0.74M sodium chloride were added to a 2% gelatin aqueous solution containing 0.08M sodium chloride and 1,3-dimethyl-2-imidazolinethione by the double jet process at 45° C. for 30 minutes while stirring, whereby the silver bromochloride grains having an average grain size of 0.30 μm and a silver chloride content of 70 mole % were obtained. Then, a KI solution of $1\times10^{-3}$ per mole of silver was added to carry out a conversion, and washing was carried out by a flocculation method according to a conventional method, followed by adding gelatin 40 g per mole of silver and adjusting pH and pAg to 6.0 and 7.6, respectively. Further, there were added 7 mg of sodium benzenethiosulfonate, 2 mg of benzenesulfinic acid, 8 mg of chlorauric acid, and 5 mg of sodium thiosulfate each per mole of silver, and heating was applied at 60° C. for 60 minutes to provide a chemical sensitization, followed by adding 350 mg of 4-hydroxy-6-methyl-1,3,3a,7-tetrazaindene as a stabilizer and Proxel as a preservative. The grains thus obtained were the silver chlorobromide cubic grains having an average grain size of 0.30 mm and a silver chloride content of 70 mole % (fluctuation coefficient: 9%).

There were added to the emulsion thus obtained, $5\times10^{-4}$ mole per mole of silver of potassium 5-[3-(4-sulfobutyl)-5-chloro-2-benzoxazolidilidene]ethylidene-1-hydroxyethoxyethyl-3-(2-pylidyl)-2-thiohydantoin as a sensitizing dye. Further added were the dye represented by the following structural formula (J) (10 mg/m$^2$), the dispersion of polyethylacrylate (250 mg/m$^2$), and further the redox compound R so that the coated amount thereof became 90 mg/m$^2$.

(J)

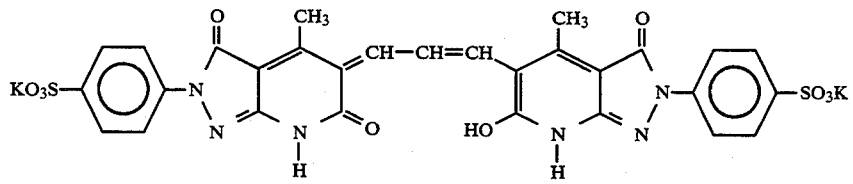

-continued

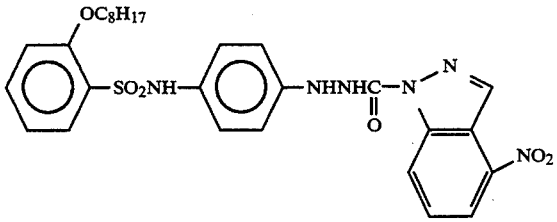

(R)

Preparation of the intermediate layer-coating solution:

There were added to a gelatin aqueous solution, the hydrazine compounds of the present invention as shown in Table 1, 5 mg/m$^2$ of sodium ethanethiosulfonate, 100 mg/m$^2$ of the dye represented by the following structural formula (K), 100 mg/m$^2$ of hydroquinone, 50 mg/m$^2$ of the triol compound represented by the following structural formula (L), and 350 mg/m$^2$ of the dispersion of polyethylacrylate, whereby the intermediate layer coating solution was prepared.

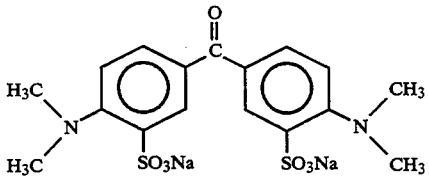

(K)

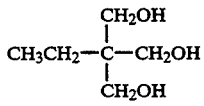

(L)

There were coated on a polyethylene terephthalate film having a subbing layer of gelatin, a layer of 0.2 g/m$^2$ of gelatin containing 40 mg/m$^2$ of bis(vinylsulfonyl)methane for the lowest layer, a hydrazine-containing layer (3.4 g/m$^2$ of Ag, 1.6 g/m$^2$ of gelatin), and a layer containing the redox compound (0.2 g/m$^2$ of Ag, 0.2 g/m$^2$ of gelatin) via an intermediate layer (0.8 g/m$^2$ of gelatin), and further provided thereon as a protective layer was a layer containing 0.3 g/m$^2$ of gelatin, 60 mg/m$^2$ of an amorphous $SiO_2$ matting agent with an average particle size of about 3.5μ, 0.1 g/m$^2$ of methanol silica, 50 mg/m$^2$ of liquid paraffin, and 5 mg/m$^2$ of the fluorinated surface active agent represented by the following structural formula-(F) and 20 mg/m$^2$ of sodium dodecylbenzensulfonate as a coating aid.

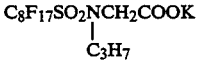

(F)

A back layer was coated with the composition shown below.

| Composition of the back layer: | |
|---|---|
| Gelatin | 3.2 g/m$^2$ |
| $SnO_2$/Sb (9/1 weight ratio, average grain size: 0.2 μm) | 200 mg/m$^2$ |
| Surface active agent, sodium p-dodecyl-benzenesulfonate | 40 mg/m$^2$ |
| Sodium dihexyl-a-sulfosuccinate | 40 mg/m$^2$ |
| Gelatin hardener, 1,3-divinylsulfonyl-2-propanol | 200 mg/m$^2$ |
| Dye the mixture of the following dyes (M), (H), (I) and (J) | |
| Dye (M) | 20 mg/m$^2$ |
| Dye (H) | 50 mg/m$^2$ |
| Dye (I) | 20 mg/m$^2$ |
| Dye (J) | 30 mg/m$^2$ |

(M)

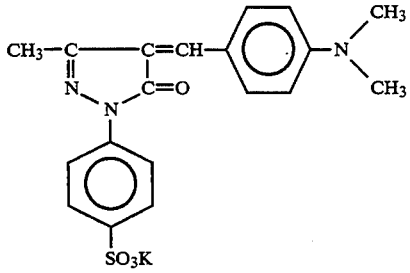

(H)

-continued

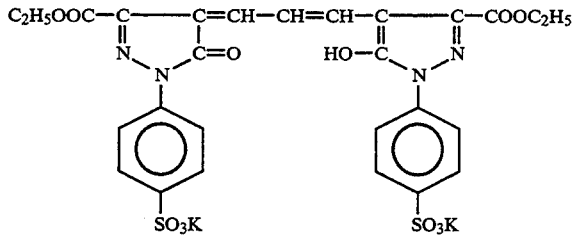

(I)

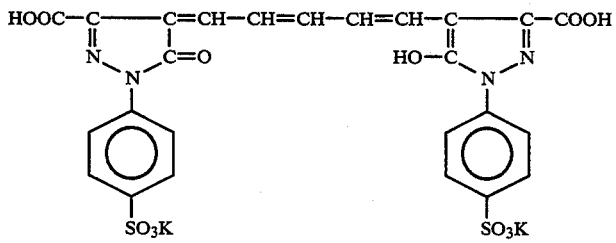

(J)

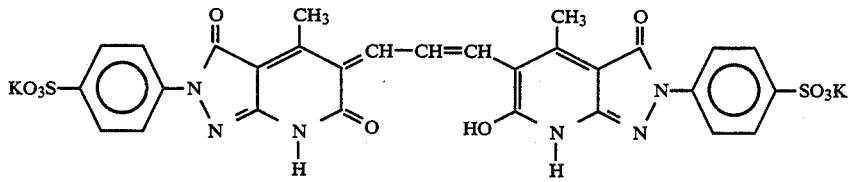

| Composition of the back Protective layer: | |
|---|---|
| Gelatin | 1.3 g/m$^2$ |
| Polymethylmethacrylate fine particles (average particle size: 2.5 μ) | 20 mg/m$^2$ |
| Sodium p-dodecylbenzenesulfonate | 15 mg/m$^2$ |
| Sodium dihexyl-α-sulfosuccinate | 15 mg/m$^2$ |
| Sodium acetate | 60 mg/m$^2$ |

Evaluation:

These samples were exposed to a tungsten light of 3200° K. via an optical wedge and a contact screen (150L chain dot type, avairable from Fuji Photo Film Co., Ltd.). Then, they were subjected to a processing with the automatic developing machine Model FG-660F (avairable from Fuji Photo Film Co., Ltd.) in the developing solution A used in Example 1 at 34° C. for 30 seconds.

GR-F1 (avairable from Fuji Photo Film Co., Ltd.) was used as a fixing solution.

A sensitivity was defined by a reciprocal of an exposure providing a density of 1.5 in the development at 34° C. for 30 seconds and expressed by the value relative to that of Sample A, which was set at 100.

The value of δ is expressed by the following equation:

$$\delta=(3.0-0.3)/[\log(\text{exposure giving a density of } 3.0)-\log(\text{exposure giving a density of } 0.3)]$$

A halftone dot gradation is expressed by the following equation:

$$\text{Halftone dot gradation}=\text{exposure giving a halftone dot area rate of } 95\% \ (\log E95\%)-\text{exposure giving a halftone dot area rate of } 5\% \ (\log E5\%).$$

Further, there were used a processing-fatigued developing solution which was the developing solution of the above mentioned composition and obtained after 150 sheets of a 100% blackened Fuji lithortho film GA-100 with a size of 50.8 cm×61 cm were processed and an air oxidation-fatigued developing solution obtained by leaving the developing solution of the above mentioned composition for standing in the stopped automatic developing machine for 3 days to carry out the same test.

The results are shown in Table 5.

TABLE 5

| | Sensitivity | | | γ | | | Halftone |
|---|---|---|---|---|---|---|---|
| Sample | Fresh solution | Processing -fatigued solution | Air oxidation-fatigued solution | Fresh solution | Processing -fatigued solution | Air oxidation-fatigued solution | gradation Fresh solution |
| 3-a (Comp.) | 100 | 84 | 87 | 13.0 | 9.1 | 8.0 | 1.38 |
| 3-b (Comp.) | 101 | 85 | 86 | 13.1 | 8.9 | 9.9 | 1.33 |
| 3-c (Comp.) | 101 | 86 | 87 | 12.9 | 8.9 | 8.0 | 1.36 |
| 3-d (Comp.) | 103 | 82 | 85 | 13.2 | 9.3 | 7.8 | 1.37 |
| 3-e (Comp.) | 101 | 83 | 85 | 12.8 | 9.1 | 8.2 | 1.38 |

TABLE 5-continued

| Sample | Sensitivity | | | γ | | | Halftone gradation |
|---|---|---|---|---|---|---|---|
| | Fresh solution | Processing -fatigued solution | Air oxidation-fatigued solution | Fresh solution | Processing -fatigued solution | Air oxidation-fatigued solution | Fresh solution |
| 3-1 (Inv.) | 102 | 94 | 96 | 13.2 | 12.5 | 12.0 | 1.41 |
| 3-2 (Inv. | 103 | 95 | 97 | 13.3 | 12.4 | 12.1 | 1.40 |
| 3-3 (Inv.) | 102 | 92 | 96 | 13.2 | 12.3 | 12.3 | 1.42 |
| 3-4 (Inv.) | 102 | 93 | 98 | 13.4 | 12.6 | 11.9 | 1.39 |
| 3-5 (Inv.) | 103 | 94 | 93 | 13.5 | 12.8 | 12.0 | 1.40 |
| 3-6 (Inv.) | 104 | 95 | 98 | 13.6 | 12.9 | 12.3 | 1.41 |

The hydrazine derivatives of the present invention can provide the light-sensitive materials which provide a high contrast and a wide halftone gradation and have a small dependency on a processing solution composition.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one silver halide light-sensitive emulsion layer, wherein at least one of i) the at least one emulsion layer and ii) another hydrophilic colloid layer(s) contains a compound represented Formula (I):

$$R^1—S—R^2—G^3—N(R^{11})—C(=X)—N(R^{12})—(R^3—L^2)_m—R^4—NHNH—G^1—R^5 \quad (I)$$

wherein $R^1$ represents an aliphatic group, an alicyclic group, or an aromatic group, which group is substituted with at least one substituent selected from the group consisting of an alkyl group, an aralkyl group, an alkenyl group, an alkynyl group, an aryl group, an amino group, a ureido group, an alkoxycarbonylamino group, an aryloxycarbonylamino group, an aryloxy group, a sulfamoyl group, a carbamoyl group, an alkyl- or arylthio group, an alkyl- or arylsulfonyl group, an alkyl- or arylsulfinyl group, a hydroxy group, a halogen atom, a cyano group, a sulfo group, an aryloxycarbonyl group, an acyl group, an acylamino group, an alkoxycarbonyl group, an acyloxy group, an aliphatic- or aromatic-carbonamido group, an aliphatic- or aromatic-sulfonamido group, a carboxyl group, a phosphoric amido group, a diacylamino group, and an imido group, and said substituents may be further substituted with at least one of said substituents;

$R^2$ represents a $—R^{21}CO—$ group, a $—R^{21}SO_2—$ group, a $—R^{21}SO—$ group, a $—R^{21}COCO—$ group, a thiocarbonyl group, an iminomethylene group, a $—R^{21}P(O)(G^2R^6)—$ group, a divalent aliphatic group, a divalent alicyclic group, or a divalent aromatic group;

$G^3$ represents a single bond, a —O— group, a $—N(R^6)—$ group, a divalent aliphatic group, a divalent alicyclic group, or a divalent aromatic group;

$R^{11}$ and $R^{12}$ each represents a hydrogen atom, an aliphatic group, an alicyclic group, or an aromatic group;

X represents an oxygen atom, a sulfur atom or a $=NR^6$ group;

$R^3$ and $R^4$ each represents a divalent aliphatic group, a divalent alicyclic group, or a divalent aromatic group;

$L^2$ represents a $—SO_2N(R^6)—$ group, a $—N(R^6)SO_2N(R^6)—$ group, a $—CON(R^6)—$ group, a $—N(R^6)CON(R^6)—$ group, or a $—G^2—P(O)(G^2R^6)N(R^6)—$ group;

$G^1$ represents a —CO— group, a $—SO_2—$ group, a —SO— group, a —COCO— group, a thiocarbonyl group, an iminomethylene group, or a $—P(O)(G^2R^6)—$ group;

$R^5$ represents a hydrogen atom, an aliphatic group, an alicyclic group, an aromatic group, an alkoxy group, an aryloxy group, or an amino group;

m represents 1;

$R^1$ and $R^{11}$, $R^1$ and $R^{12}$, $R^{11}$ and $R^{12}$, and $R^1$, $R^{11}$ and $R^{12}$ may be combined with each other to form a ring;

$G^2$ represents a single bond, a —O— group or a $—N(R^6)—$ group;

$R^6$ represents a hydrogen atom, an aliphatic group, an alicyclic group, or an aromatic group;

$R^{21}$ represents a single bond, a divalent aliphatic group, a divalent alicyclic group or a divalent aromatic group.

2. The silver halide photographic light-sensitive material as in claim 1, wherein said substituent is an aryl group when $R^1$ is an alkyl group; said substituent is an alkyl or an aralkyl group when $R^1$ is an aryl group; and said substituent is an alkylthio group, an arylthio group, an amino group, a carbamoyl group, an alkoxycarbonyl group, an acylamino group, a sulfonamido group, a ureido group, or a phosphoric amido group, when $R^1$ is an alkyl group or an aryl group.

3. The silver halide photographic light-sensitive material as in claim 1, wherein the aliphatic group, alicyclic group and aromatic group represented by $R^{11}$, $R^{12}$, $R^2$, $R^{21}$, $R^3$, $R^4$ and $R^5$ each is a substituted group with at least one of substituent selected from the group consisting of an alkoxy group, an alkyl group, an aralkyl group, an alkenyl group, an alkynyl group, an aryl group, an amino group, a ureido group, an alkoxycarbonylamino group, an aryloxycarbonylamino group, an aryloxy group, a sulfamoyl group, a carbamoyl group, an alkyl- or arylthio group, an alkyl- or arylsulfonyl group, an alkyl- or arylsulfinyl group, a hydroxy group, a halogen atom, a cyano group, a sulfo group, an aryloxycarbonyl group, an acyl group, an alkoxycarbonyl group, an acyloxy group, an aliphatic- or aromatic-carbonamido group, an aliphatic- or aromatic- sulfonamido group, a carboxyl group, a phosphoric amido group, a diacylamino group, and an imido group, said substituents may be further substituted with at least one of said substituents.

4. The silver halide photographic light-sensitive material as in claim 1, wherein $R^{11}$ and $R^{12}$ each represents an aliphatic group, alicyclic group or aromatic group substituted with at least one of an alkyl group, an aralkyl group, an alkoxy group, a mono- or di-substituted amino group, an acylamino group, an aliphatic- or aromatic- sulfonamido group, a ureido group, or a phosphoric amido group.

5. The silver halide photographic light-sensitive material as in claim 1, wherein $R^{11}$ and $R^{12}$ each represents a hydrogen atom, an alkyl group substituted with an alkylthio group or an arylthio group, an alkyl group or an aryl group.

6. The silver halide photographic light-sensitive material as in claim 1, wherein $R^2$ is a $—R^{21}CO—$ group, a $—R^{21}SO_2—$ group, a $—R^{21}COCO—$ group, $—R^{21}P(O)(G^2R^6)—$ group, a divalent aliphatic group, a divalent alicyclic group, or a divalent aromatic group.

7. The silver halide photographic light-sensitive material as in claim 1, wherein $L^2$ is a $—SO_2NR^6—$ group.

8. The silver halide photographic light-sensitive material as in claim 1, wherein $G^3$ is a single bond, a —O— group, or a $—N(R^6)—$ group.

9. The silver halide photographic light-sensitive material as in claim 1, wherein X is an oxygen atom or a sulfur atom.

10. The silver halide photographic light-sensitive material as in claim 1, wherein $G^1$ is a —CO— group.

11. The silver halide photographic light-sensitive material as in claim 1, wherein $G^1$ is a —CO— group and $R^5$ is a hydrogen atom, an alkyl group, an aralkyl group and an aryl group.

12. The silver halide photographic light-sensitive material as in claim 1, wherein the compound represented by Formula (I) is contained in an amount of from $1\times10^{-6}$ to $5\times10^{-2}$ mol per mol of silver halide.

13. The silver halide photographic light-sensitive material as in claim 1, wherein the compound represented by Formula (I) is incorporated in said at least one emulsion layer.

* * * * *